US011158156B2

(12) United States Patent
Moore et al.

(10) Patent No.: US 11,158,156 B2
(45) Date of Patent: Oct. 26, 2021

(54) SYSTEMS AND METHODS FOR UTILIZING DATA CAPTURED BY DETECTING COMPONENTS OF AN RFID-ENABLED TABLE SYSTEM

(71) Applicant: Walker Digital Table Systems, LLC, Las Vegas, NV (US)

(72) Inventors: Stephen Moore, Las Vegas, NV (US); Boyd Scott, Las Vegas, NV (US)

(73) Assignee: Walker Digital Table Systems, LLC, Las Vegas, NV (US)

( * ) Notice: Subject to any disclaimer, the term of this patent is extended or adjusted under 35 U.S.C. 154(b) by 0 days.

(21) Appl. No.: 16/051,541

(22) Filed: Aug. 1, 2018

(65) Prior Publication Data

US 2018/0357850 A1 Dec. 13, 2018

Related U.S. Application Data

(63) Continuation of application No. PCT/US2017/018552, filed on Feb. 19, 2017.

(60) Provisional application No. 62/297,792, filed on Feb. 19, 2016.

(51) Int. Cl.
*G07F 17/32* (2006.01)

(52) U.S. Cl.
CPC ..... *G07F 17/322* (2013.01); *G07F 17/3211* (2013.01)

(58) Field of Classification Search
CPC ..... G07F 17/322; G07F 17/3211
See application file for complete search history.

(56) References Cited

U.S. PATENT DOCUMENTS

| | | | | |
|---|---|---|---|---|
| 7,611,417 | B2 | 11/2009 | Murrey et al. | |
| 2004/0070149 | A1 | 4/2004 | Lipscomb et al. | |
| 2007/0117604 | A1* | 5/2007 | Hill | G07F 17/3258 463/16 |
| 2008/0076529 | A1 | 3/2008 | Richards et al. | |
| 2008/0113767 | A1 | 5/2008 | Nguyen et al. | |

(Continued)

FOREIGN PATENT DOCUMENTS

WO WO2015/164523 10/2015

OTHER PUBLICATIONS

Written Opinion for Application No. PCT/US17/018552 dated Jun. 22, 2017; 16 pps.

(Continued)

*Primary Examiner* — Werner G Garner
(74) *Attorney, Agent, or Firm* — RowanTree Law Group, PLLC; Magdalena M. Fincham

(57) ABSTRACT

In accordance with some embodiments, provided herein is a table system for facilitating a card game (e.g., a baccarat or blackjack card game) that includes LED or other lighting components under the felt covering of the table, which lighting components are used to communicate information to players of the game. In some embodiments, different lighting effects are used to communicate different information (e.g., a first lighting effect is used to indicate a bet spot with that has the highest wager or that qualifies for a special benefit). In some embodiments, the table system also includes RFID components. Various processes and system designs are provided herein to minimize or eliminate interference (e.g., magnetic field interference) between the lighting components and the RFID components.

19 Claims, 9 Drawing Sheets

(56) References Cited

U.S. PATENT DOCUMENTS

| | | | | |
|---|---|---|---|---|
| 2009/0131151 | A1 | 5/2009 | Harris et al. | |
| 2010/0105460 | A1 | 4/2010 | Makhoul et al. | |
| 2014/0191474 | A1 | 7/2014 | van Linden | |
| 2014/0200071 | A1* | 7/2014 | Czyzewski | G07F 17/3204 463/25 |
| 2014/0274253 | A1 | 9/2014 | Chun | |
| 2014/0295948 | A1* | 10/2014 | Helgesen | G07F 17/3248 463/25 |
| 2015/0151189 | A1 | 6/2015 | Chun | |

OTHER PUBLICATIONS

International Search Report for Application No. PCT/US17/018552 dated Jun. 22, 2017; 4 pps.
Search Report for Singapore Application 11201805875Q dated Dec. 5, 2019; 3 pps.
Written Opinion for Singapore Application 11201805875Q dated Dec. 5, 2019; 7 pps.
Office Action for Chinese Application No. 201780011557.7 dated Jul. 24, 2020; 17 pps.
Written Opinion for Singapore Application No. 11201805875Q dated Oct. 15, 2020; 7 pps.

* cited by examiner

SYSTEMS AND METHODS FOR UTILIZING DATA CAPTURED BY DETECTING COMPONENTS OF AN RFID-ENABLED TABLE SYSTEM

CLAIM OF PRIORITY

This application is a Continuation Application of PCT Application No. PCT/US17/018552, filed on Feb. 19, 2017 in the name of Stephen Moore et al. and titled SYSTEMS AND METHODS FOR UTILIZING DATA CAPTURED BY DETECTING COMPONENTS OF AN RFID-ENABLED TABLE SYSTEM, which PCT Application claims the benefit of U.S. Provisional Application No. 62/297,792, filed Feb. 19, 2016 in the name of Stephen Moore et al. and titled SYSTEMS AND METHODS FOR MINIMIZING INTERFERENCE AMONG ELECTRONIC COMPONENTS OF AN RFID-ENABLED GAMING SYSTEM. The entirety of each of these applications is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

SUMMARY

The present embodiments are directed to an RFID-enabled gaming table system (e.g., a smart table operable to facilitate a card game, such as baccarat, blackjack or poker) which includes both (i) detecting components for detecting data related to the game being played at the table system (e.g., radio frequency identification (RFID) components or optical imaging components) and (ii) lighting components such as light emitting diode (LED) components (collectively "LED components" herein) for outputting information to players and/or dealers. In some embodiments the information output by the lighting components is based on data captured by the detecting components. In one embodiment, each game area of a plurality of game areas (e.g., each bet spot) of such a gaming table is equipped (e.g., under the felt outer surface of the table) with its own RFID antenna for reading data from RFID-enabled wagering chips placed thereon and with its own set of LEDs for communicating information relevant to that bet spot.

DETAILED DESCRIPTION OF VARIOUS EMBODIMENTS

Figure 1:
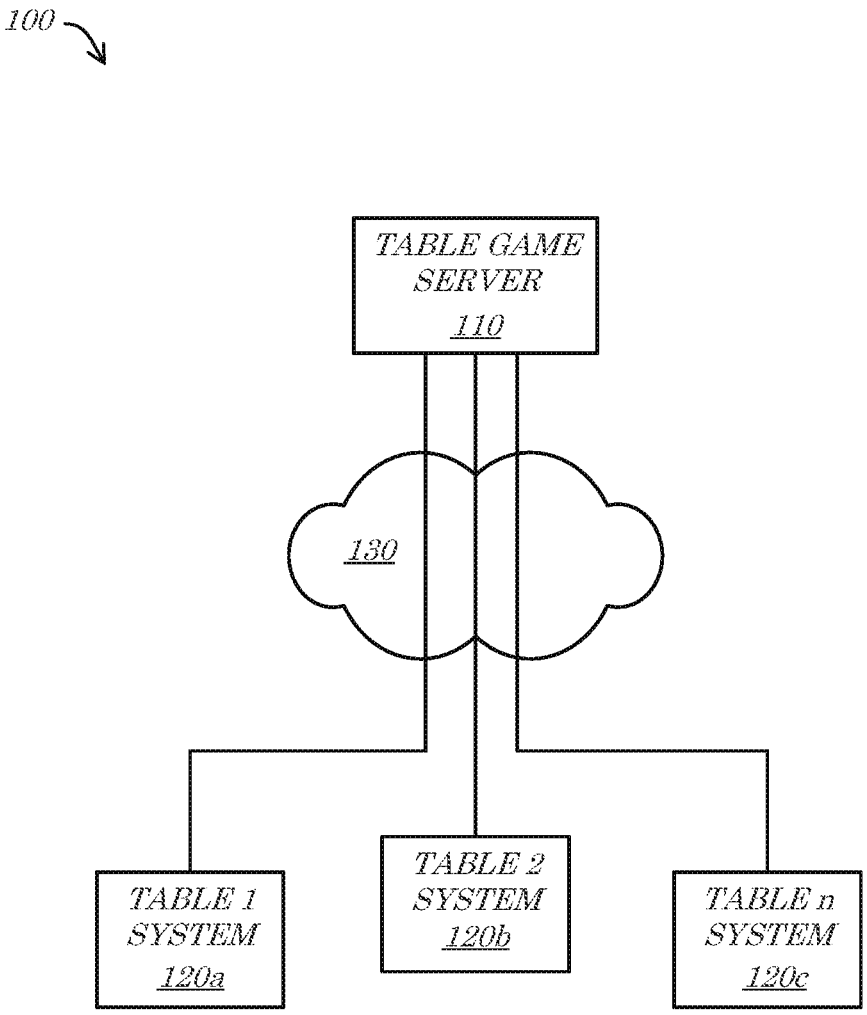
FIG. 1 illustrates an example system operable to facilitate at least some embodiments described herein.

In accordance with some embodiments, the LED components of the table are used to communicate or output information to individuals proximate to the table or individuals able to view the table (e.g., players of a game at the table, remote players viewing the table remotely or the dealer of the game). In accordance with some embodiments, such information may be based on data gathered via use of the RFID or other detecting components of the table (e.g., based on wagers or wagering chips detected by RFID antennas at bet spots of the table). For example, the data gathered by the RFID components of the table may be used to determine which player position or bet spot corresponds to the highest wager for a current game event or whether a player has placed a specially designated wagering game element (e.g., a wagering chip associated with special functionality) on a particular bet spot and the LED components can be directed to light up in a particular color or lighting effect in order to communicate this information to players of the table. In another example, the LED components of the table can be used to communicate other wagering-related information to players, such as that betting is about to close for a current hand (e.g., the LED components could begin to blink more rapidly, begin to fade or get brighter as betting is about to close, to indicate to players that they should finalize placement of their wagers).

In some embodiments, instructions to one or more LED components are transmitted automatically be a controller of the table based on a program being implemented by the controller (e.g., when the controller determines that a wagering chip has been placed on a particular bet spot or that a remote player has placed a wager on a bet spot, it is programmed to instruct the LEDs of that bet spot to light up in a certain color or with a certain lighting effect). In other embodiments, a dealer or other operator associated with the table may manually direct that an instruction be transmitted to one or more LED components (e.g., a dealer may actuate a mechanism to indicate that betting for a particular hand will close in 30 seconds and this may cause the controller to instruct all the LEDs at all the bet spots to blink or take on some other specified lighting effect to indicate that the close of betting is fast approaching).

In accordance with some embodiments, a table system as described herein may include both RFID components and LED components located within close proximity to one another, which may pose magnetic field or other interference problems that need to be addressed in order for the table system to function with sufficient reliability, consistency, and/or accuracy. Applicant describes herein embodiments of gaming table system designs (as well as methods and software for operating such) that address the various challenges posed by including both RFID and LED components in the table system (which become particularly important to address when an RFID component is in close proximity to an LED component, such as when both types of components are included in a given bet spot of the table).

Other gaming table system designs that provide for minimizing and/or eliminating interference between the RFID components of a gaming table system (specifically the magnetic field generated by such components during RFID tag readings) and signals transmitted to a LED components of the gaming table system are also contemplated. In accordance with some embodiments, some gaming table system designs specifically provide for minimizing and/or eliminating interference between the electrical currents generated by LED components of the gaming table system during high electrical activity events and the reading of RFID tags by the RFID antennas or the reading of data from such RFID antennas by a processor of the table. For example, some embodiments utilize a software-based solution which manages the timing of instructions to the LED components such that the transmission and/or implementation of the instructions to update or modify a state of an LED component does not interfere with a reading of data from an associated RFID component. In another example, other embodiments utilize a two-circuit-board solution that involves placing RFID components on a first circuit board, placing the LED components on a second circuit board and attaching the two circuit boards to a substrate of the table using stand-offs in a manner that provides space (e.g., a ½" to 1") between the two circuit boards, so as to minimize interference between the magnetic fields generated by the components. One or more of these solutions may also, in some embodiments, involve utilizing a substrate made out of aluminum as a mounting surface for the two circuit boards, to further reduce the possibility of any potential interference.

Still further described herein are various gaming table system designs that, in some embodiments, separate the RFID operations of the table (e.g., the functionality of managing and tracking wagering activity, such as by receiving/transmitting data to/from RFID antennas) from the LED operations of the table (e.g., transmitting instructions to LED circuits to control changes to the status of such circuit) so as to minimize or eliminate any disruptions to the RFID operations by a primary controller of the table.

In accordance with some embodiments, the systems and methods described herein provide for effectively controlling the LED components of an RFID-enabled smart table (while maintaining a visually pleasing and consistent LED presence on the table) without unacceptably compromising the RFID functionality of the table, given at least one of the following considerations: (i) the electrical activity of LED components during certain events; (ii) the magnetic field created during certain events by the RFID components of the table; and (iii) the desire to prioritize, with respect to the main controller of the table, the RFID operations of the table over the LED operations of the table.

In accordance with some embodiments, a smart gaming table comprises a main controller and is equipped with one or more RFID antennas which operate to identify and track wagering activity at the table (e.g., the antennas may operate to recognize placement or movement of RFID-enabled wagering chips on the table and to communicate data to at least one processor). The main controller may be operable to perform functions such as, without limitation, managing the polling of RFID antennas and communicating with other components of the table (e.g., an electronic card shoe, an RFID-enabled chip tray, a dealer input mechanism) to acquire wager data, recognize wagers placed, determine a result of a game event, calculate the correct payouts to be made by a dealer and payments to be collected by the dealer and verify that correct amounts have been paid and collected at the end of each game event. The gaming table may further be equipped with one or more LED components (e.g., for outputting information to game participants and/or dealers). In accordance with some embodiments, such LED components may need to be updated (e.g., to light up certain lights on a light strip, to light up in a different color or pattern, to turn on or off, etc.) based on game activity or other factors, such that signals or instructions may need to be communicated to such LED lights. Unfortunately, due to the relatively close proximity of the LED light components and RFID components of the table in some table system designs, there is, in such implementations, a significant potential for interference between the electrical currents of LED light circuits during periods of high electric activity and the ability of the RFID antennas to read data from RFID tags within their range. There is also significant potential, in such implementations, for a magnetic field generated by an RFID component to interfere with a signal being sent to a nearby LED circuit. Interference or unreliability in signal may cause inaccuracies in the data (which may in turn cause inaccuracies in the financial transactions associated with the game being played on the table) and/or enjoyment of the game (e.g., delays in the output of information or aesthetically unpleasing light displays). Additionally, relying on the main controller of the table to both send appropriate instructions to the LED components and manage RFID-based wagering activity at the table may cause a decrease in speed, efficiency, reliability and/or accuracy of the main controller's ability to send and receive data to/from both the RFID components and the LED components in a timely manner. Applicant has recognized that there is a need to configure the components, placement of the components, timing of signals and/or communication protocols among the components of such a gaming table such as to minimize or eliminate the possibility of interference among the data being transmitted to and/or from the two types of components and allow signals to both types of components to be transmitted in a timely and reliable manner.

In accordance with one embodiment, provided herein is a gaming table system design (and methods for operating such) which provides for coordinating the timing of RFID antenna polling and the timing of LED circuit activity such that the electrical activity of an LED circuit is maintained in a "steady state" (a state which comprises low electrical activity that is unlikely to have an adverse impact on any nearby RFID readings) during certain RFID operations on RFID components of the table that are likely to be negatively impacted by high electrical activity of the LED circuit (e.g., while an RFID antenna that bears a predetermined relationship to the LED circuit is reading an RFID tag). Examples of predetermined relationships that an LED circuit may bear to a subject RFID component include, without limitation: (i) being within a predetermined distance of a subject RFID component; (ii) being within the same predetermined area of the table as the subject RFID component; (iii) being within a range of electrical signals or field generated by the LED circuit; (iv) having an associated predetermined category or class of LED circuits (e.g., LED circuits that within a player station area); (v) being located within a predetermined light strip that is associated in a memory of the table controller as corresponding to the subject RFID component; and/or (vi)

the LED circuit being associated with the RFID component in a database. For example, in one embodiment, when an antenna of a gaming table is reading or attempting to read RFID tags, the LED component(s) which bear a predetermined relationship to that antenna may be powered and displaying a solid color (e.g., the last color that they were instructed to display, in embodiments which include multicolor LEDS, but not blinking, diming, or performing any operation that involves high-speed LED circuit current changes). Then, when the controller proceeds to activate another antenna that does not bear a predetermined relationship to the LED component(s) (e.g., an antenna in a part of the table that is sufficiently far away from the LED component(s)), an instruction or signal may be transmitted to the LED component(s) to execute actions (e.g., change status or implement a particular lighting effect) that comprise high electrical activity.

In accordance with one embodiment, provided herein is a gaming table system design (and methods for operating such) which includes (i) LED components (e.g., LED light strips which include a plurality of lights and at least one Integrated Circuit (IC) for controlling the lights); (ii) a main controller (comprising at least one processor and associated logic) which communicates with the RFID components of the gaming table system in order to identify and manage desired updates for the LED lights along with identifying and tracking the RFID-enabled wagering chip activity at the table and (iii) at least one node controller which serves as an intermediary between the LED components and the main controller such as to allow reliable and smooth updating of the LED lights in a manner which does not interfere with the operations of the main controller (e.g., with the main controller receiving and/or transmitting data to the RFID components of the table gaming system).

In accordance with some embodiments, provided herein is a gaming table system design (and methods for operating such) which manages the RFID and LED operations of a gaming table such that the main controller of the table (i) determines, for at least one RFID component of the table that is located in a first area of the table, that the RFID component has finished a first type of RFID operation; and (ii) transmits, upon such determination, to a node controller of the table, an update command for at least one LED component that is located in the first area of the table. In accordance with one embodiment, the update command may include data such as an indication of how the at least one LED component is to be updated (e.g., which bet spots are to be lit up, based on wagering data acquired by the main controller). In accordance with some embodiments, the node controller translated the data received from the main controller into more detailed instructions or signals and sends these to the at least one LED component. In this manner, the LED operations performed by the main controller are limited and minimize any potential for interruption to the RFID operations of the main controller. In other embodiments, the main controller of the table communicates with the at least one LED component directly. In accordance with some embodiments, the LED circuits of the at least one LED component are held in a steady, low power, state between updates from the node controller and/or main controller.

In accordance with some embodiments, provided herein is a gaming table system design (and methods and software for operating such) for facilitating a card game at a table equipped with lighting components (such as the LED components described herein) that comprises a plurality of game areas (e.g., bet spots) and that is operable to (i) receive data from a first detecting component (e.g., an RFID antenna or imaging device), the detecting component from which the data is received being associated with a first game area of the plurality of game areas, the first game area also corresponding to a first lighting component; (ii) retrieve information on a plurality of potential gaming events that can occur in association with card games playable at the table system, each potential gaming event corresponding to a respective lighting effect (e.g., retrieve this information from a database or other memory associated with the table system); (iii) determine, based on the data, that a first potential gaming event of the plurality of potential gaming events is occurring ("is occurring" also including events that are about to occur or are predicted or expected to occur based on current game data) with respect to a current card game being played at the table system, thereby determining a first lighting effect that corresponds to the first potential gaming event in accordance with the information; (iv) identify at least one lighting component to be updated with the first lighting effect corresponding to the first potential gaming event; and (v) transmit an instruction to the at least one lighting component, instructing the at least one lighting component to implement the first lighting effect. In some embodiments, the at least one lighting component to which the instruction is transmitted is the first lighting component (i.e., the lighting effect instruction is sent to the light component of the same game area or bet spot from which data was received). In other embodiments, the instruction regarding the lighting effect is transmitted to a different lighting component than the one associated with the game area or bet spot from which the data was received or to a plurality of light components (in which plurality the first light component may or may not be included).

It should be noted that although several embodiments described herein refer to the table system including RFID components. A table system comprising RFID components may be referred to herein as an RFID-enabled table. An RFID-enabled table, as the term is used herein, comprises a table operable to facilitate a game (e.g., a card game such as baccarat) and equipped with at least one RFID antenna or other RFID component (described in more detail elsewhere herein). In other embodiments, the table system may be an imaging-enabled table or include other types of technology that serves as the mechanism via which data (e.g., wagering data or other game-related data) is gathered by the table system, other types of technologies for gathering data may be implemented and used to update the status of one or more lighting components of the table.

Examples of an RFID-enabled table that may be useful for at least some embodiments described herein are described in (i) U.S. Patent Publication No. 2016/0016071, filed on Sep. 28, 2015 in the name of Walker et al. and entitled RFID SYSTEM FOR FACILITATING SELECTIONS AT A GAME APPARATUS; (ii) U.S. Pat. No. 9,262,885 filed on Jun. 5, 2012 in the name of Moore et al. and entitled METHODS AND SYSTEMS FOR FACILITATING TABLE GAMES, each of which is incorporated by reference herein. Some examples of other technologies that may be utilized to implement at least some embodiments described are described in the following patents: (i) U.S. Pat. No. 5,782,647 to Fishbine et al.; (ii) U.S. Pat. No. 5,103,081 to Fisher et al; (iii) U.S. Pat. No. 5,548,110 to Storch et al.; and (iv) U.S. Pat. No. 4,814,589 to Storch et al. Each of the foregoing patents are incorporated by reference herein and disclose various systems and methods for encoding information on chips and for determining information encoded in the color, geometry, size or patterns on a chip, any of which technologies may also be utilized to encode information on a playing card in accordance with some embodiments described herein.

A table that is equipped with RFID-enabled technology, optical imaging technology or other technology that allows reading of data from one or more game elements used for games playable on the table is referred to as an electronic table herein. For purposes of clarity, the example embodiments described herein will primarily refer to an RFID-enabled table but it should be understood that some embodiments may alternately be implemented using an optical imaging-enabled table that utilizes imaging technology to read data from game elements (e.g., to read bar codes or other codes embedded in or included on one or more playing cards). The embodiments described herein are not limited to implementations utilizing RFID or imaging technology and other technologies may be substituted for the RFID and optical imaging example implementations described herein.

In accordance with some embodiments, systems, processes and articles of manufacture provide for leveraging the technology (e.g., RFID-reading capability or optical imaging capability) of an electronic table for functions such as detecting when a particular game event occurs or is expected to occur based on a current game state and outputting information in a visually pleasing manner using LED components, wherein a lighting effect for the LED components is selected based on the particular game event that is determined to be occurring or predicted to occur.

DETAILED DESCRIPTION OF SOME EMBODIMENTS

Described herein are systems, processes and articles of manufacture which provide for facilitating wagering activity on an RFID-enabled table (e.g., wagering activity in a baccarat, blackjack or roulette game) that also includes at least one LED component. An RFID-enabled table, as the term is used herein, comprises a table operable to facilitate a game (e.g., a card game such as baccarat) and equipped with at least one RFID antenna which operates to read data from RFID tags which may be included in wagering chips placed on the table (described in more detail elsewhere herein). In accordance with some embodiments, systems, processes and articles of manufacture provide for adding the functionality of LED lighting to such a table, thereby allowing the lighting up of bet spots or other areas of the table (e.g., by placing LED lights underneath the felt or other covering of the table), in a manner which does not interfere with (or minimally interferes with) the RFID operations of the table.

In accordance with some embodiments, at least one node controller is included as an electronic component of the table, serving as an intermediary between the main controller of the table and the LED lights of the table. For example, the at least one node controller may be operable to (i) receive at least one signal or instruction from the main controller, the instruction indicating how a status of at least one LED light of the table should be modified; (ii) translate the signal or instruction into a second instruction for transmission to the at least one LED light; and (iii) transmit the second instruction to the at least one LED light. In accordance with some embodiments, the signals or instructions transmitted to the at least one LED light of the table (whether through a node controller or directly from the main controller of the table) are timed such that, for a particular LED light or LED light strip, an instruction is transmitted at a time when an RFID antenna within a particular range or vicinity of the LED light or LED light strip is not being polled or actively communicated with, so as to avoid an interruption, corruption or loss of integrity to either the signal being transmitted to the LED light or LED light strip and/or the signal to/from the RFID antenna.

In accordance with some embodiments, the timing of the instructions sent to the LED lights of the table is coordinated with the polling or reading of the RFID antennas of the table, so as to avoid sending instructions (or certain more complex instructions) to the LED lights when an RFID component located within a certain proximity to the LED light to which an instruction is to be sent is being energized or within a certain state that causes a magnetic field to be generated in the area of the RFID component.

Various systems and several examples are provided herein. The present disclosure will focus on baccarat as an example, but it should be appreciated that similar functionality may be applied to other RFID-enabled table games such as blackjack, roulette, craps, Sic Bo, Pai Gow (tile and poker variations), and poker games including LET IT RIDE™, CARIBBEAN STUD™, 3-CARD POKER, 4-CARD POKER, SPANISH 21, variants of such games (e.g., Chemin de Fer), or the like.

Referring now to FIG. 1, illustrated therein is a system 100 which may be useful in implementing at least some embodiments described herein. The system 100 may comprise, for example, a system within a particular gaming establishment which includes a plurality of smart tables for facilitating card games. In accordance with at least some embodiments, the system 100 includes a table game server 110 (e.g., for tracking and managing chip, player and/or game activities at one or more connected smart tables). The table game server may, in accordance with some embodiments, be in communication, via a communications network 130, with one or more table systems 120*a*, 120*b* and 120*c*. The table game server 110 may communicate with the table systems 120 directly or indirectly, via a wired or wireless medium such as the Internet, LAN, WAN or Ethernet, Token Ring, or via any appropriate communications means or combination of communications means. Any of the table systems 120*a*, 120*b* and/or 120*c* may comprise computers, such as those based on the INTEL® PENTIUM® processor, that are adapted to communicate with the table game server 110. Any number and type of table systems 120 may be in communication with the table game server 110, although only three (3) in the example of FIG. 1.

Communication between the table systems 120 and the table game server 110, and (in some embodiments) among the table systems 120, may be direct or indirect, such as over the Internet through a Web site maintained by table game server 110 on a remote server, via an intranet or over an on-line data network including commercial on-line service providers, bulletin board systems and the like. In yet other embodiments, the table systems 120 may communicate with one another and/or table game server 110 over RF, cable TV, satellite links and the like.

Some, but not all, possible communication networks that may comprise network 130 or be otherwise part of system 100 include: a local area network (LAN), a wide area network (WAN), the Internet, a telephone line, a cable line, a radio channel, an optical communications line, a satellite communications link. Possible communications protocols that may be part of system 100 include: Ethernet (or IEEE 802.3), SAP, ATP, Bluetooth™, and TCP/IP. Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

In some embodiments, the table game server 110 may not be necessary and/or preferred. For example, at least some embodiments described herein may be practiced on a stand-alone table system 120 and/or a table system 120 in communication only with one or more other table systems 120 or a dedicated server device. In such an embodiment, any functions described as performed by the table game server 110 or data described as stored on the table game server 110 may instead be performed by or stored on one or more table systems 120.

Figure 2A:
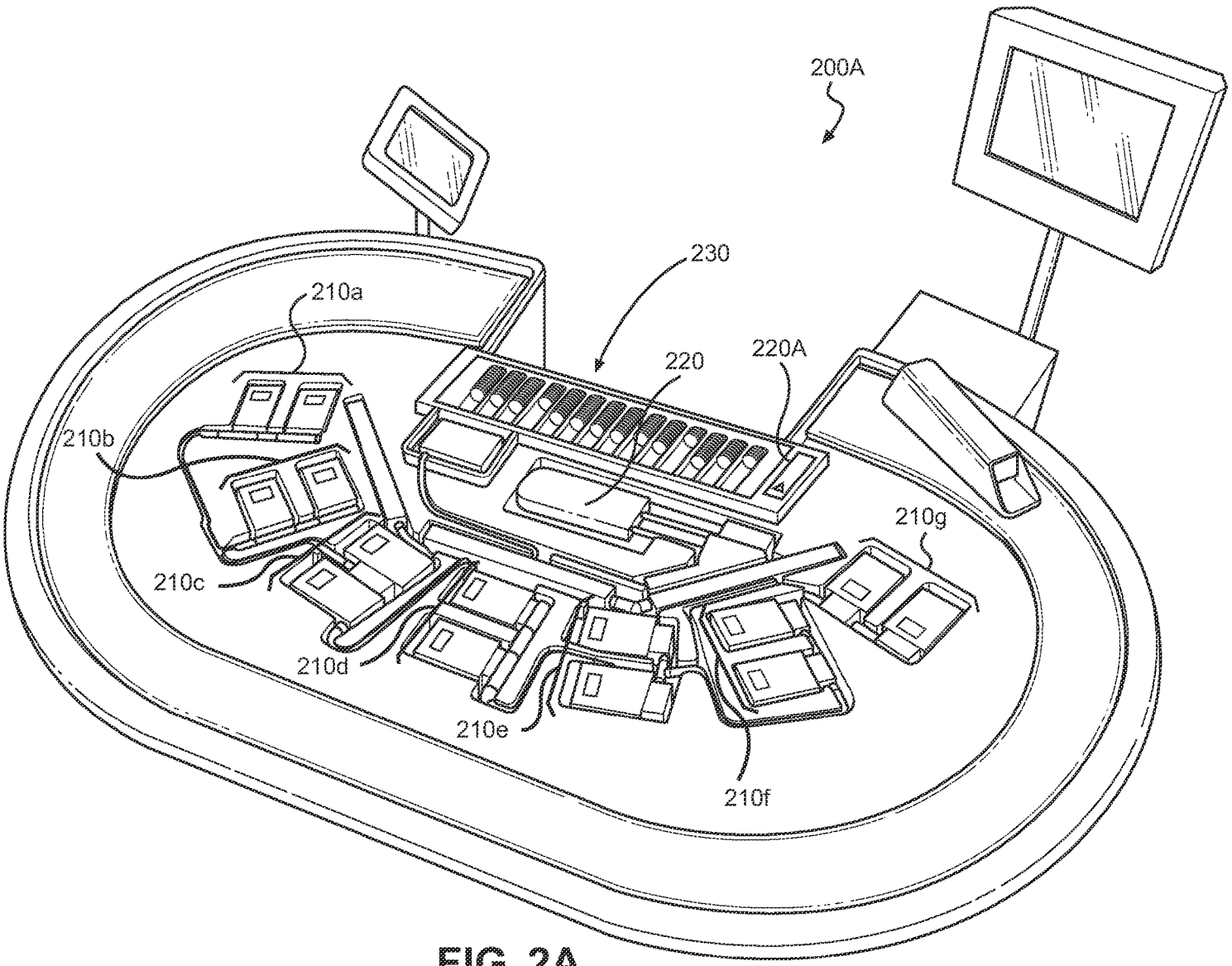
FIG. 2A illustrates a diagram of an antenna layout on a smart table for facilitating a baccarat game, in accordance with some embodiments.

Referring now to FIG. 2A, illustrated therein is one embodiment of a smart table 200A (e.g., a table which comprises electronic components, including at least one processor) which includes a plurality of antennas (which may be one embodiment of table system 120 of FIG. 1), in a manner that facilitates some of the embodiments described herein. The table 200A includes seven (7) distinct player positions arranged in a semi-circular configuration. In other embodiments, a different number of player positions and/or a different configuration may be used; the embodiments described herein are not dependent on any particular number of player positions or configuration of player positions. Placed at each respective player position is a set of two antennas 210*a*-210*g*, one for each bet spot or bet position available at each respective player position. For example, one antenna at a respective player position may be for recognizing a bet on Banker win (e.g., recognizing RFID-enabled chips placed on the Banker bet spot) and the other antenna may be for recognizing a bet on Player win (e.g., recognizing RFID-enabled chips placed on the Player bet spot). In accordance with some embodiments, for each pair of antennas at a player position, the bet spot closer to the chip tray or the "upper" bet spot may be for a Banker bet spot while the bet spot closer to the edge of the table at which game participants sit may be considered the Player bet spot. Thus, if a player were to place a wager (e.g., one or more RFID-enabled chips) on a bet spot associated with one of the antennas at the player position associated with the set of antennas 210*a*, the antenna would recognize such placement (i.e., the antenna nearest to which the chips are placed would "acquire" the chip(s) comprising the wager).

The table illustrated in FIG. 2A further comprises a dealer area at which is positioned an antenna 220. The dealer area antenna 220 may facilitate, for example, calculations and verifications of stack totals for table fills, credits, buy-ins and color-ups (e.g. by reading and providing data regarding one or more chips acquired by the dealer area antenna 220).

In accordance with some embodiments, a smart table 200A includes an RFID-enabled chip tray 230 within which is placed at least one antenna 220A. In some embodiments, an RFID-enabled chip tray comprises two layers or trays (e.g., an upper tray and a lower tray within the same housing) and each tray may be associated with (e.g., have placed within its area) its own antenna. For example, one antenna may be placed beneath the upper tray and function to read the chips in the upper tray while another antenna may be placed beneath the lower tray and function to reads the chips in the lower tray. In one embodiment, the trays may be read or "scanned" independently (i.e., the value or other data of chips placed therein may be read); in other embodiments, the chips in the upper and lower trays may be read simultaneously. In one embodiment, the chip tray antenna(s) 220A may interact with the dealer area antenna 220 (or a processor which receives data from both the chip tray antenna(s) 220A and the dealer area antenna 220 may take into account the data of the antenna(s) 220A along with the data of the antenna 220) to ensure that chips implicated in certain transactions are actually recognized as having been placed into the chip tray after being counted and confirmed on the dealer antenna.

In some embodiments (not shown in FIG. 2A), a smart table may include at least one shared or common bet positions or bet spots, each associated with a distinct antenna. For example, in one embodiment particular types of additional bets may be made available via shared or common bet positions and each such bet spot may include its own antenna: one antenna may be placed at a Player Pair bet spot, another antenna may be placed at a Banker Pair bet spot, and two antennas may each be placed at a Tie bet spot. Further, Applicants have recognized that in some cases, it may be beneficial to provide for common or "shared" betting areas. That is, rather than associating or providing a plurality of physical betting areas for each individual player seated at the gaming table, it may be beneficial to instead offer one or more common betting areas (each associated with a given wager type), accessible to all players. Each such common or shared bet spot may have associated therewith its own antenna.

In some embodiments, player wagers placed upon such shared betting areas of the gaming table may be identified and/or associated with respective player(s) having placed such wagers via one or more RFID antennas incorporated into the layout of the table itself. In one embodiment, a player desiring to place such a wager may indicate his interest in doing so (e.g. audibly, via a hand signal) to the dealer. Thereafter, the dealer may place physical chips representing the player's wager on a first dedicated area of the gaming table associated with the player (e.g., a player position of the table at which the player is sitting), the first dedicated area being associated with a particular RFID antenna. The RFID antenna may then transmit an indication of the wager amount and associated player (or player position) to a processor (e.g., a processor of the table system), which then stores data associated with the wager. Thereafter, the dealer (and/or player) may move the chips representing the player's wager to a second "shared" area of the gaming table, which may be associated with a second RFID antenna. Upon resolution of a game instance associated with the wager (e.g. upon completion of a hand of baccarat), an outcome associated with the wager is determined (e.g. win/loss) along with any corresponding payout that may be entitled to the player. If the player is entitled to a payout, the dealer may then place chips representing such payout on the second dedicated area of the table. The payout is recorded by the table computer via the second RFID antenna. The original wager and payout may then be placed on the first dedicated are (associated with the first RFID antenna), serving to thereby record an indication of the payout having been provided to the associated player.

In accordance with some embodiments, RFID antennas incorporated into a smart table such as table 200A may be placed within an insert under the felt or other covering of the table. Each antenna may have a predetermined range within which it recognizes, determines, identifies or acquires a chip. Thus, if one or more chips comprising a wager is placed within the acquire range of a particular antenna, it may be inferred or determined that a player (e.g., the player who is associated with the acquired chip(s)) is placing a bet on the bet spot associated with the antenna.

It should be noted that the number and placement of antennas illustrated in FIG. 2A is exemplary only and should not be construed in a limiting manner. For example, more than two antennas may be associated with a given player position. In some embodiments, a first antenna associated with a given player position is associated with a first player (e.g., the primary player playing at that position) while a second antenna associated with a given player position is associated with a second player (e.g., a remote player or back betting player). In some embodiments, each antenna of a table may be uniquely identified, such that if data or information is received from a particular antenna, that data or communication may comprise a unique identifier of the antenna that allows for a determination of the bet spot and player position associated with that data or communication.

An antenna utilized in an RFID-enabled smart gaming table (e.g., such as any of those illustrated with respect to FIG. 2A) may determine, read, receive, obtain, recognize or determine various information or data from or about an RFID-enabled chip placed within a predetermined range of the antenna. The following are examples or some of the information or data that may be so determined: (i) a unique chip identifier, which uniquely identifies the chip; (ii) a currency of the chip; (iii) a denomination of the chip (which may be its monetary value; in the case of a token it may comprise the token type); (iv) a chipset identifier, which differentiates types of chips or represents a category of a chip (e.g., cash vs. non-negotiable, promotional, differentiating tokens from monetary chips, chip validity); (v) a casino identifier that uniquely identifies a casino or other registered gaming corporation associated with the chip (this information may also be used to determine chip validity); and (vi) a site identifier that uniquely identifies the physical casino site for which the chip is valid. It should be noted that not all of the above information is necessary or desirable for all embodiments. It should further be noted that any or all of the above-listed information may be stored in a memory of a given chip and transmitted to an antenna via a signal from the chip.

An RFID-enabled chip which may be used in at least some embodiments may include (i) an RFID tag or memory, (ii) an electronic circuit or processor and (iii) an antenna. An RFID-enabled chip usable in at least some embodiments may be similar or identical to those disclosed in U.S. Pat. Nos. 5,166,502; 5,676,376; 6,021,949; and 6,296,190, and U.S. Patent Application Publication Nos. 2004/0207156 and 2004/0219982 which are all incorporated by reference in their entireties. No particular type of RFID-enabled chip is required for the embodiments described herein, so long as the chip can support the functionality described with respect thereto. In some embodiments, each chip may store in its memory (and communicate to an antenna of a table as described herein) a unique serial number, a chipset identifier, an associated player identifier or other information. The gaming establishment (e.g., casino) or other entity may associate values, categories, denominations or other values with each serial number. The association may be in a look-up table or the like. Alternatively, the unique identifier of a given chip may be encoded to include information therein. Likewise, a chip may be color-coded or include other indicia that indicates a value or other information to the player or dealer. In some embodiments, plaques may be used instead of chips (e.g., for exceedingly large denominations).

In some embodiments, an RFID-enabled chip may be an active chip which includes its own battery or power source. In other embodiments, an RFID-enabled chip may be a passive chip which does not include its own power source. In on embodiment, an electronic circuit and antenna of a given chip may act as a transponder capable of responding to an antenna of the table (e.g., an antenna of an RFID-enabled chip tray of the table). The antenna may be a sensor or other component operable to detect, recognize, determine, identify or sense the presence (or absence) of an RFID-enabled chip. The antenna may also be operable to detect, determine, identify, recognize or receive various information about a chip (e.g., chip identifier, chip set identifier, chip denomination, chip status, etc.).

In accordance with some embodiments, an antenna of a table (e.g., an antenna of a wagering position, such as an antenna of the set of antennas 210*a* and/or an antenna 220A of a chip tray) may send out an electromagnetic signal that impinges upon the antenna of an RFID-enabled chip, exciting a current within electronic circuit of the chip. In response to the excited current, the electronic circuit of the chip may cause the antenna of the chip to emit a second electromagnetic signal as a response, which is received by the antenna of the table which had sent out the electromagnetic signal. The second signal may comprise identifying information about the chip such that the antenna can identify the chip on receipt of the second signal. The second signal may be generated passively or actively. That is, in a first embodiment, the energy from the interrogation signal provides sufficient power for the electronic circuit of the chip to use to send the second signal. In a second embodiment, the electronic circuit of the chip may include a battery or other power source, which is used to power the generation of the second signal.

In accordance with some embodiments, an antenna of a table (e.g., of a player bet spot, shared wagering spot or chip tray) may also be operable to transmit information to one or more processors or memories (e.g., information regarding the presence, absence or movement of a chip in a certain location, an identifier and/or denomination of a chip, etc.). Such one or more processors or memories may be components of (i) a table, (ii) a component of a table (e.g., of a dealer display or chip tray) and/or (iii) a server device operable to communicate with one or more tables. In accordance with some embodiments (e.g., when referring to a processor of a smart table), such one or more processors and memories may be referred to as a "controller" or Core Gaming System (CGS). As described in more detail elsewhere herein, a CGS may be operable to perform certain functions with respect to a smart table, such as (i) controlling the polling (e.g., reading or requesting data from) one or more RFID antennas of the table, (ii) analyzing or interpreting such data to determine wagering activity at the table, (iii) processing such data to determine actions, outputs or signals that should be undertaken based on such data and/or (iv) storing chip placement information (e.g., information about RFID-enabled wagering chips placed on wagering positions of the table, such as the identifiers and/or denominations of wagering chips and which player positions they have been placed on or removed from).

In one embodiment, a CGS may poll one or more antennas of a smart table (e.g., in accordance with a schedule or program and/or in response to events in a hand being played on the table) in order to obtain or receive data from such antennas. Thus, in some embodiments, the CGS may received data from one or more RFID antennas upon polling the antenna and requesting such data (in other embodiments an RFID antenna may more proactively transmit data to the CGS or another processor independent polling functionality). In accordance with some embodiments the CGS may determine, based on the data received from one or more RFID antennas, (i) information that should be output on a dealer display and/or one or more dealer displays, (ii) a payout that should be made to a player; (iii) a commission that should be collected by a dealer; (iii) whether an additional wager may be accepted based on a status of a game event; (iv) whether an alert should be generated based on a discrepancy of expected vs. actual inventory of chips in a chip tray, and (iv) whether a status of one or more LED components of the table should be updated and/or modified.

Figure 2B:
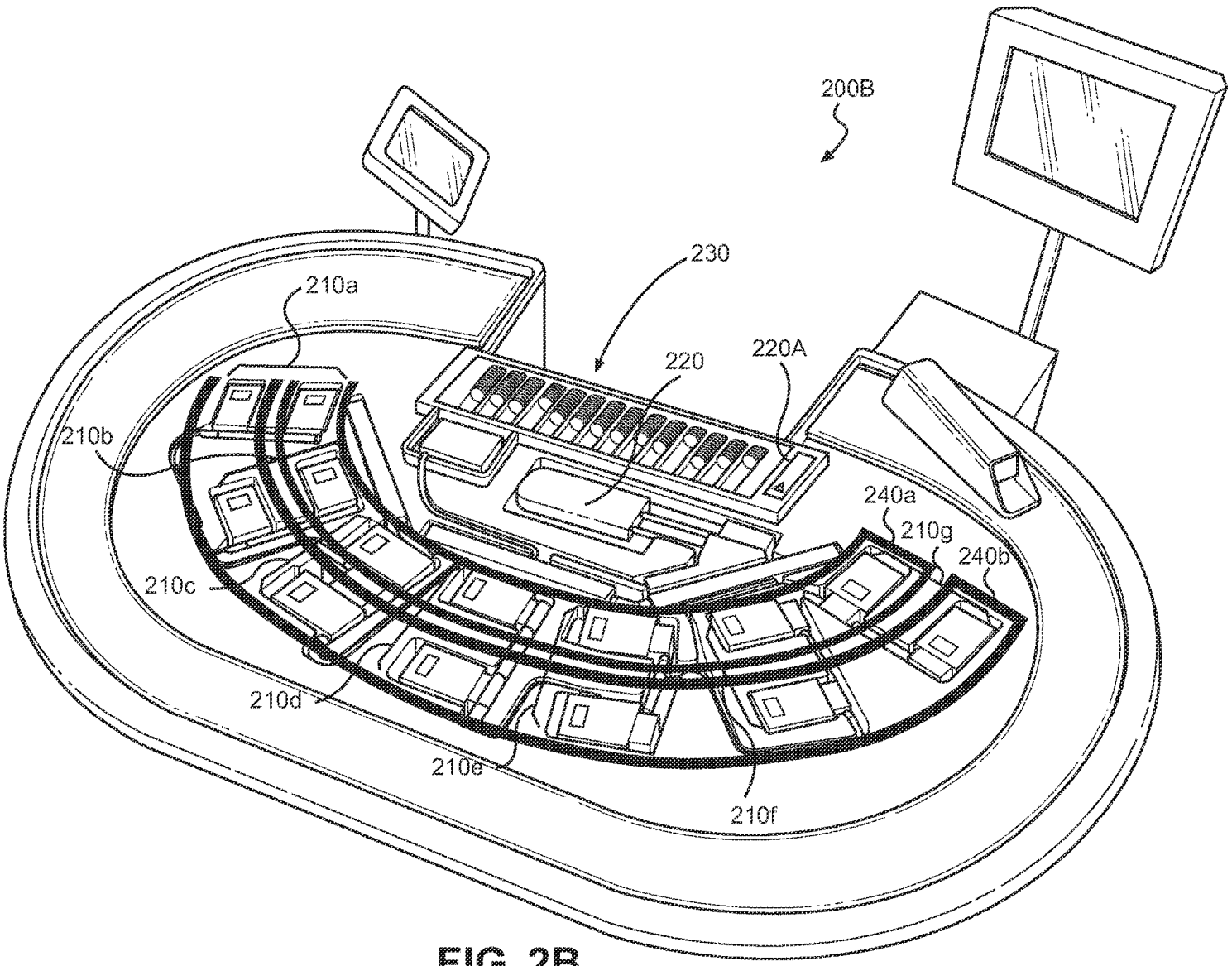
FIG. 2B illustrates the diagram of FIG. 2A but with 4 LED strips included in the layout, in accordance with some embodiments.

Referring now to FIG. 2B, illustrated therein is a smart table 200B that is similar to the smart table 200A of FIG. 2A but with additional electronic components included. In particular, the smart table 200B includes two (2) LED components 240*a* and 240*b*. In accordance with some embodiments, such LED components may comprise LED light strands or strips. The LED light strips may, in accordance with some embodiments, be placed under the felt or other covering of the smart table and used to backlight or highlight certain desired areas of the table (e.g., as a mechanism for outputting information to a game participant and/or dealer). Additional description of an LED light strip is provided herein with respect to FIG. 4 and will not be repeated for purposes of brevity.

In accordance with some embodiments, the LED light strip look 240*a* is placed under the Banker bet spots of the table and the LED light strip loop 240*b* is placed under the Player bet spots of the table. In accordance with some embodiments, different sections or portions of a given LED light strip loop may be lit up in a particular manner For example, in accordance with some embodiments, different bet spots may be "lit up" using LED lights in order to output information such as (i) which bet spots players have placed wagering chips on, to make this information more readily visible to viewers of the table; (ii) which bet spot has the "highest wager" for a given hand; (iii) which bet is a winning bet once a hand has been resolved; (iv) which winning bet has the biggest win; (v) which bet is a losing bet once a hand is resolved; (vi) which bet spots are currently available for placement of wagers; (vii) which bet spots are currently unavailable for placement of wagers; and (viii) a problem with detecting sufficient information from a chip detected on a bet spot. In accordance with different colored lights or light patterns may be utilized to indicated different information.

In the example embodiment of FIG. 2B, the two LED components two LED light strands being utilized are each configured as an open loop, with one strand placed above and below the Banker bet spot antennas of each of the player positions 1-7 and the other strand placed above and below the Player bet spot antennas of each of the player positions 1-7. In accordance with one embodiment, the LEDs of a given LED component 240*a* and 240*b* are individually addressable. Accordingly, portions of a given light strip may be turned on and off (or the LEDS of certain portions may be instructed to change color or utilize a particular lighting effect) in order to convey certain information to game participants and/or dealers (e.g., to indicate which bet spot has the highest wager for the current hand, which wager corresponds to the Squeeze player, which wagers are winning wagers, etc.). For example, if it is desired to light up the Banker bet spot in player position 210*c*, an instruction to those LEDs placed above and below that particular bet spot may be transmitted, causing these particular LEDs of the light strip to turn on (the instruction may, in some embodiments, also indicate which color and effect to utilize, such as slow fade). For example, as described in more detail with respect to FIG. 4, at least one node controller may be a component of the smart table and be operable to determine (e.g., based on an LED map stored in a memory accessible to the node controller) (i) which area of the table is to be lit up and how; (ii) which light strip and which particular LEDs on that light strip should be instructed to turn on in order to light up the desired area of the table; and (iii) transmit an instruction or signal to those particular LEDs (the instruction, in some embodiments, including information regarding the color and effect to be utilized if the instruction is for turning on the LEDs). In accordance with some embodiments, other configurations of LED lights may be utilized. Additionally, in some embodiments electronic components other than LED light strips may be utilized to allow for lighting up certain portions of a table through the felt or other covering of the table.

Referring now to FIG. 3, illustrated therein is a planar view of a smart table 300A, which may be operable to facilitate one or more embodiments described herein. The table 300A may comprise the smart table 200A of FIG. 2A, but with a felt or other covering hiding the antennas and LED components placed underneath. In many respects, the smart table 300A may appear to a player as a regular baccarat table, with the RFID and LED capabilities of the table not being readily discernable until such functionality is utilized. The table 300A is configured for a baccarat game but the embodiments described herein are not limited to baccarat and a similar table may be provided with a top layout appropriate for facilitating another game (e.g., blackjack or poker).

The rules of baccarat are well understood, but the interested reader is directed to www.wizardofodds.com/baccarat for a more detailed explanation. Table 300A comprises a smart table configured to facilitate a baccarat game and includes a dealer area within which is located a dealer display 322 and an RFID-enabled chip tray 320. The dealer display may be utilized to output data or prompts to a dealer during the course of game play (e.g., a commission amount to be collected from one or more players, a payout to be provided to one or more players, an amount in lost wagers to be collected from one or more players, an alert regarding one or more missing chips which is to be rectified by the dealer, etc.).

The table 300A further includes seven (7) player positions 310*a*-310*g*, each player position including a Banker bet spot and a Player bet spot. Of course, any number of player positions may be utilized. Further, in some embodiments the table may include additional bet spots such as shared or common bet spots.

The table 300A further includes a display 340 which a dealer or other gaming establishment personnel may utilize to access information regarding game events, transactions, chip tray variances or other data related to the table 300A. The table 300A further includes another display 350 which faces the players and may show data to players such as recent historical outcomes (sometimes referred to as a "trend board"). Players sometimes use such historical outcomes in an effort to predict trends within a series of game instances. The table 300A further includes an electronic card shoe 360 via which cards for the game are shuffled and dealt. In accordance with some embodiments, the electronic card shoe 360 may communicate with a processor (e.g., a processor of the table 300) to communicate data regarding cards dealt and/or remaining in the shoe.

The table 300A may include additional components (at least some of which may not be easily visible to a player or other observer) such as one or more processors, a memory storing a general program and one or more specialized software applications which, in combination with data obtained from the RFID antennas located on the table, may facilitate many of the functions described herein (e.g., tracking wagering activity and game outcomes, determining which bet spots or other areas of the table are to be lit up and in what color and/or effect, etc.).

It should be noted that the pairs of antennas 210*a*-210*g* (FIGS. 2A and 2B) correspond to the player positions 310*a*-310*g*, such that the pair of antennas 210*a* is located underneath the player position 310*a*, the pair of antennas 210*b* is located underneath the player position 310*b*, etc. In accordance with one embodiment, for each pair of antennas 210*a*-210*g* the upper antenna (the one located closer to the dealer position) is located underneath the Banker bet spot of a given player position and operates to detect wagers placed on the Banker bet spot of that player position while the lower antenna (the one closer to the edge of the table at which the game participants sit) is located underneath the Player bet spot and operates to detect wagers placed on the Player bet spot of that player position.

Figure 3A:
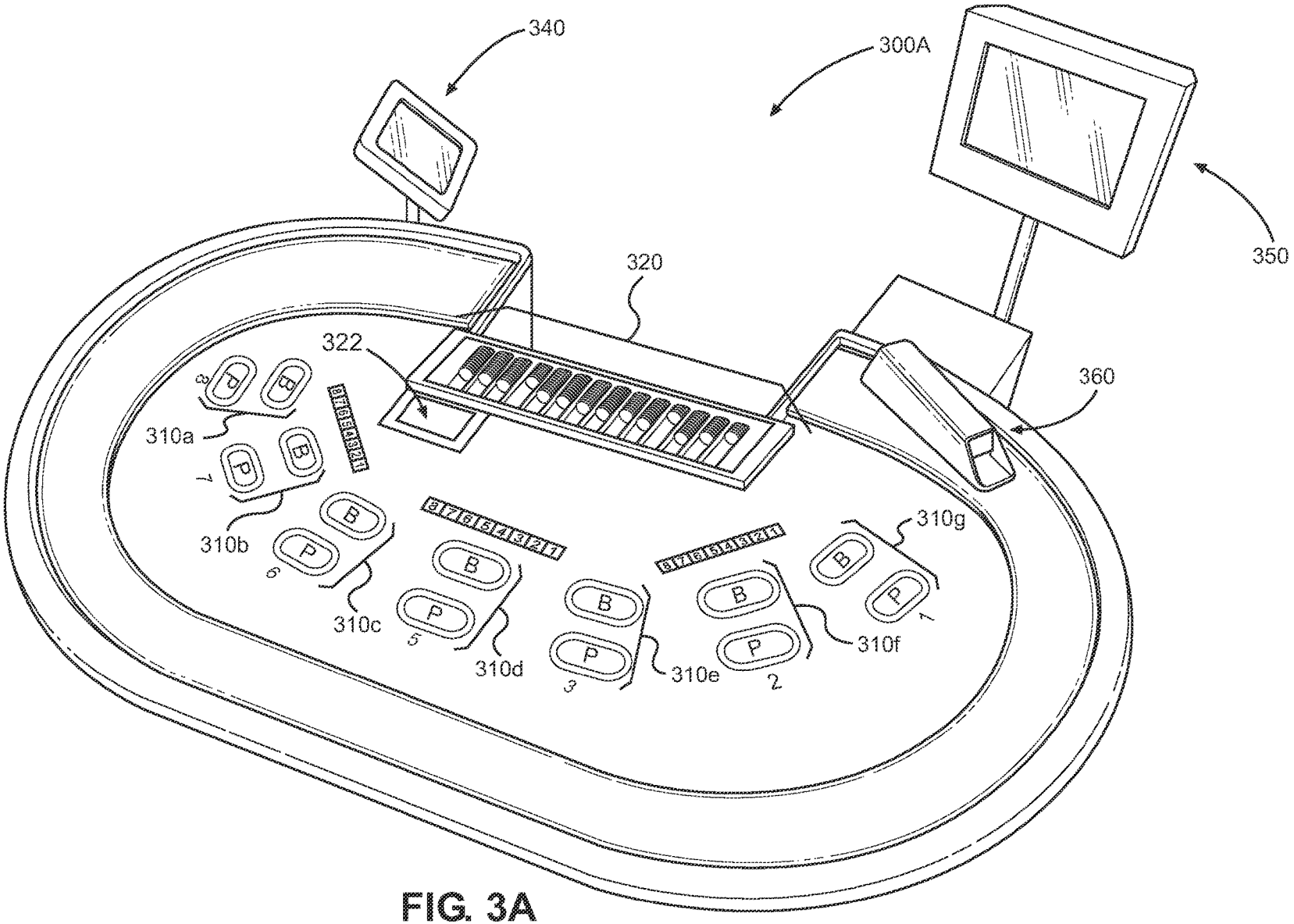
FIG. 3A illustrates a top planar view of a smart table for facilitating a baccarat game, in accordance with some embodiments.
Figure 3B:
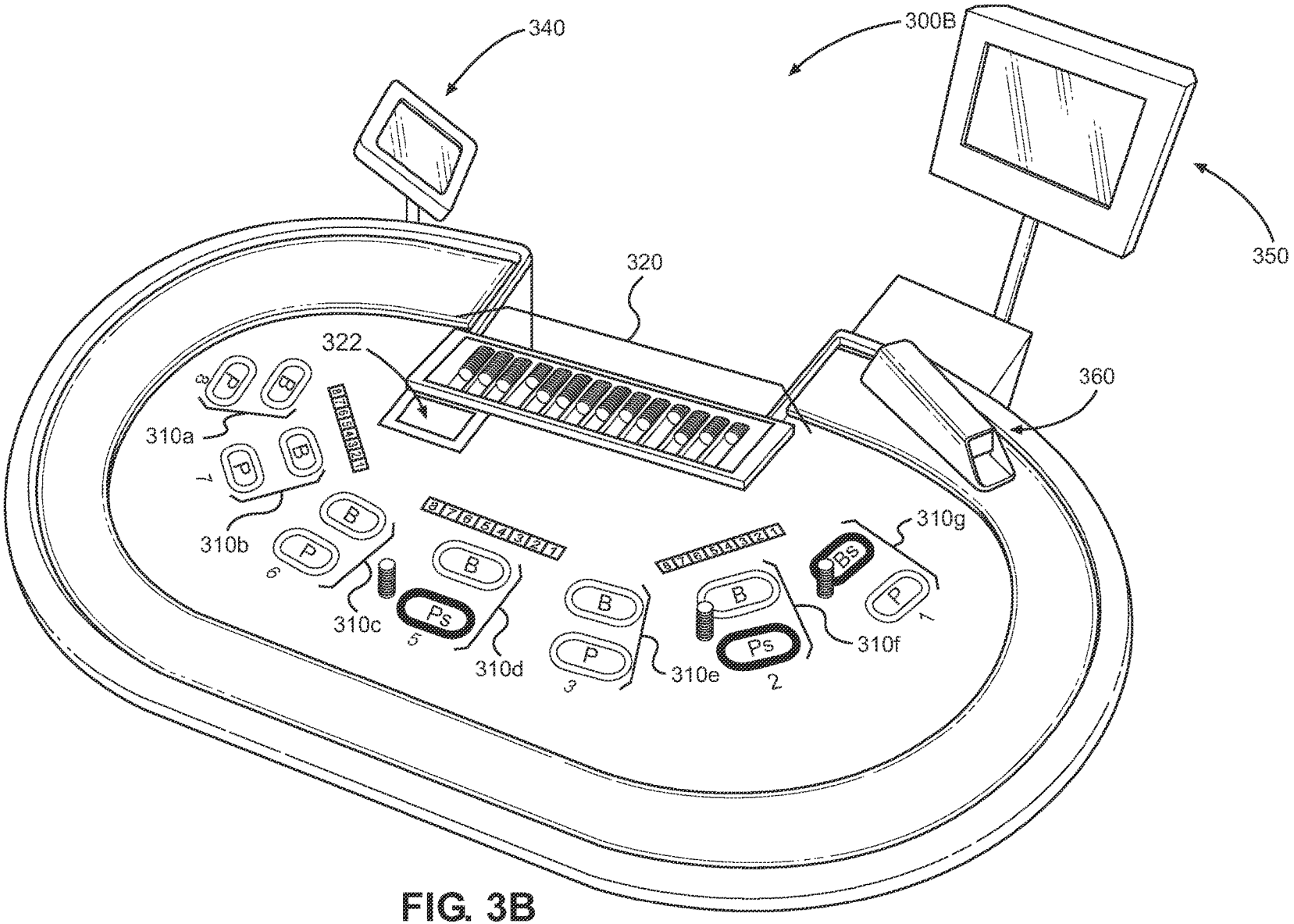
FIG. 3B illustrates a top planar view of a smart table as in FIG. 3A, but with several of the bet spots lit up to indicate a first type of information to at least one game participant.

Referring now to FIG. 3B, illustrated therein is the smart table of FIG. 3A but at a point in a game of baccarat at which several of the bet spots have been lit up to convey information to a player (the version of the smart table conveyed in FIG. 3B, with its updated status of lighting, is referred to as table 300B herein). In the example of FIG. 3B, different fill in the oval borders of the various Player and Banker bet spots are utilized to indicated different colored lights or lighting effects, as such may be used to convey information to a game participant or dealer. For example, solid black fill is representative of a first color, hashed fill is representative of a second color and white fill is used to indicate an unlit LED component. It should be noted that although the example embodiment of FIG. 3B indicates whether an area is lit up using LED lights by modifying the fill in the border of a bet spot, this is for convenience in clearly illustrating how information may be indicated using different colored lights and lighting effects and is not intended to limit how or what portion of a table may be lit up to indicate such information. For example, in other embodiments the entire bet spot may appear lit up in different colors depending on what information is being indicated (rather than just the border of the bet spot).

In the embodiments of FIG. 3B, solid black fill borders around the ovals representing the Player bet spot at player position 5 (310*d*), the Player bet spot at player position 2 (310*f*) and the Banker bet spot at player position 1 (310*g*) are utilized to indicate that these bet spots have been lit using the LED components underneath the felt, to convey information to a game participant, dealer or other viewer of the table. For example, as can be seen in FIG. 3B, the bet spots which now have solid black fill borders are ones which have had chips placed thereon (e.g., RFID-enabled chips which may be detected via the RFID antennas underneath the covering of the table). Thus, in accordance with one embodiment, the lighting of certain bet spots is utilized to indicate that wagers have been placed on these bet spots. Utilizing the LED lighting makes this information more easily discernable to a viewer of the table than does the mere presence of the RFID-enabled chips on these bet spots.

In some embodiments, LED lighting may be utilized to indicate activity of a game participant who is participating remotely in the hand being dealt (e.g., to indicate wagers made by a remote player who is placing wagers electronically and is not physically present at the table). In such embodiments, the lighting up of a bet spot may be an effective manner of indicating to viewers of the table that wagers have been placed on certain bet spots even if a game participant is not physically present at the table to place chips on the bet spot to indicate his/her wager.

It should be noted that LED lighting effects may be utilized to indicate many different types of information to viewers of the table. Different information may be represented, for example, via different colors (e.g., green lights light up, at the resolution of a hand, bet spots on which winning wagers have been placed while red lights light up bet spots on which losing wagers have been placed), different lighting effects (e.g., blinking or pulsating lights, slow or quick fade in or out, rapidly changing color of lights, etc.).

Figure 3C:
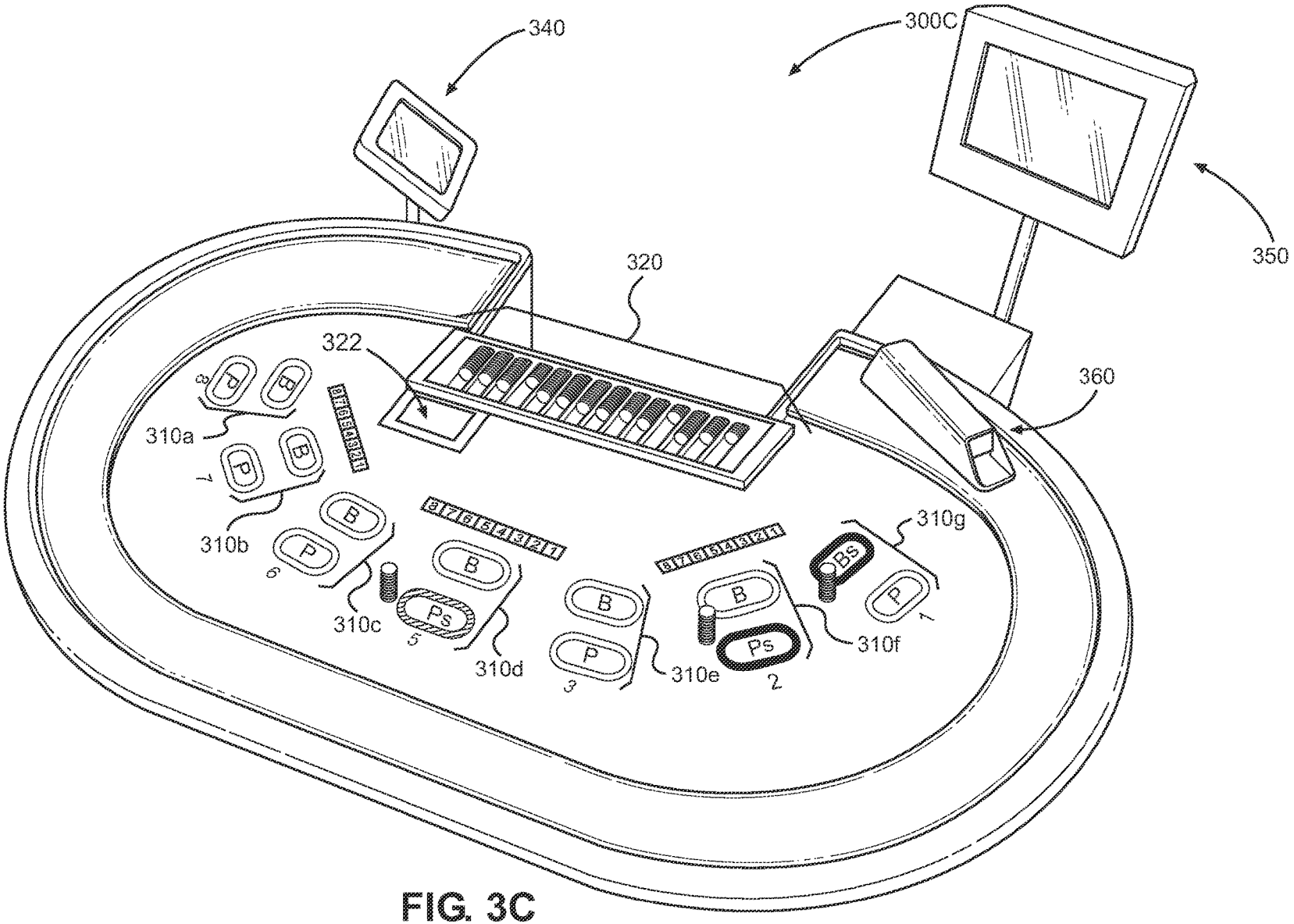
FIG. 3C illustrates a top planar view of a smart table as in FIG. 3B, but with one of the bet spots lit up to indicate a second type of information to at least one game participant.

Referring to FIG. 3C, illustrated therein is the smart table of FIG. 3B but now including an indication of which wager of the wagers placed is the highest wager placed for the hand (the version of the smart table conveyed in FIG. 3C, with its updated status of lighting to indicated highest wager, is referred to as table 300C herein). In the example of FIG. 3C, a hash fill is utilized to indicate a different colored light (different from the color indicated by the solid black fill) as being utilized to indicate the highest wager. As can be seen in FIG. 3C, it is the player at player position 5 who has placed the highest wager (in some embodiments this may also be the Squeeze bettor indication).

The following are some examples of additional types of information (in addition to conveying that a wager has been placed on a particular bet spot) that may be conveyed via LED lighting components of a table: (i) an addition or removal of a wagering chip to a bet spot that has previously had a wager placed thereon for a current game event; (ii) an indication that a wagering chip has been lost and then re-sighted on a bet spot (the presence of the chip has "flickered"); (iii) an indication that a player has associated their bet spot with a tie pair wager; (iv) an indication that a player has somehow modified their wager during a period and/or in a manner when such actions are allowed; (v) an indication that a player has somehow modified their wager during a period and/or in a manner when such actions are not allowed; (vi) an indication of which player is the Squeeze bettor for the current hand or game event; (vii) an indication that betting for the current bet event is now closed; (viii) an indication of winning bets, losing bets, highest winning bet and/or biggest losing bet; (ix) an indication that game play is suspended (e.g., due to an error, a fill transaction or other event); (x) an indication that chip tray inventory testing is currently being conducted; (xi) an indication that a player has been overpaid or underpaid by a dealer; (xii) an attract mode for an available player position and/or bet spot; (xiii) a highlighting of a game or game provider logo; (xiv) an indication that a player, player position and/or wagering chip placed on the table qualifies for a bonus event (e.g., a "lucky chip" has been recognized on the table or a chip has been selected as qualifying for some special bonus, prize or privilege).

As described herein, different types of information may be conveyed using different colors, color combinations and lighting effects. Game state information (e.g., information related to wagers or other card game events, such as the highest wager placed for a game or that an error in collecting a wager or in paying a win has occurred at a particular player position) may be indicated. In some embodiments, table system component status (e.g., that there is an error in reading the chip tray contents or that an antenna is not functioning properly) or game element status (e.g., the fact that an RFID wagering chip is determined to be faulty or have an inconsistent signal and should thus be taken out of circulation) may also be output using various lighting effects. For example, a green light may be utilized for all winning bets and a flashing or pulsating green light may be utilized to indicate the highest winning bet. Low lighting may be used to indicate certain information while bright lighting may be used to indicate other information.

In accordance with some embodiments, a memory accessible to a table system may store information in a database or other memory scheme, the information indicating the various states or statuses of a game, table system component or gaming element that may be detectable or determinable based on data collected via one or more detector components of the table system and the one or more lighting effects corresponding to each such state or status. For example, a memory accessible to a processor or controller of a smart table configured in accordance with embodiments described herein may store such a database or information (e.g., memory 414 of the CGS 410).

Table 1 below is an example of a database or table storing information indicating the various states or statuses of a game, table system component or gaming element that may be detectable or determinable based on data collected via one or more detector components of the table system and the one or more lighting effects corresponding to each such state or status. Table 1, in accordance with some embodiments, may be utilized to summarize some different game states or events, table system component statuses or events or game element status which may be indicated using LED components of a table, including what game state or table system component such indications may be used for and at least one example lighting effect that may be utilized to convey game or table status information to a viewer of the table (e.g., a player at the table, a remote player viewing a video or image of the table or a dealer or other casino personnel).

TABLE 1

Example Lighting Effect and Corresponding Game Events

| Category of Game or Component Event | Sub-state or Event | New action, event, or existing condition/status | Lighting effect |
|---|---|---|---|
| Table status | Table open | Table is in open status | Outlined bets spots |
| | Table closed | Table is in closed status | Indicator on dealer display such as logo outline |
| | Table idle | Table is on open status but has had no activity for a configured window of time | Attract lighting scheme with various animations |
| Game state | Between-game wagering round (pre-game, post-game) | Any chip on any bet spot lights that bet spot | low brightness/ animation rate |
| | Tie-pair wager association | Player associates their bet spot with a tie pair wager | coordinated animation between player position and tie-pair lighting |
| | Game start | All bet spots with wagers on them | all currently lit bet spots blink. Solid, higher brightness on bet spots with wagers |
| | Wager rebook | Initial value of booked bet changes after game starts | Bet spot flashes to confirm wager change |
| | Squeeze | High or "squeeze" bettor on Player and Banker sides | slightly higher brightness at game start relative to other players, higher brightness/animation rate during squeeze |
| | Game end | Winning and losing bet spots are known | Green/celebration for winners, Red for losers, animations for tie/pair winners, major celebration for biggest winner |
| | Back betting | Bet spot includes back bet | Bet spot cycles between two colors |
| Error states | Table error | Table error present including over differential/table max | All table positions light red until error is resolved |
| | Position error | Error present on a specific bet spot such as under minimum bet, over max bet, bet cap, chip pinch | Relevant table position(s) light red |
| | Chip flicker | chip is lost and re-sighted | muted indication on relevant antenna location |
| | Table connectivity lost | Table loses connectivity to network | Flashing indicator in dealer antenna location |
| | axis testing | axis testing is continuously active | colors/animations proportional to test results |

TABLE 1-continued

Example Lighting Effect and Corresponding Game Events

| Category of Game or Component Event | Sub-state or Event | New action, event, or existing condition/status | Lighting effect |
|---|---|---|---|
| | Chip tray out of balance | Chip tray expected balance does not batch actual balance | Flashing indicator in dealer antenna location that stops when variance is adjusted by authorized user |
| | Invalid chip sighted | Chip invalid for play sighted on table | Relevant table position(s) light red |
| Table management | Dealer antenna transaction in progress | Fill, credit, buy-in or change transaction in progress | Dealer antenna position is lighted and turns green briefly when transaction is confirmed |
| | Chips on dealer antenna | Dealer places chips on dealer antenna work area | Dealer antenna lighting is outlined |
| | Table override in progress | Authorized user is executing an override action such as bet override, card override or game override | Game paused, slow pulse on player positions |
| | Chip tray scan in progress | Chip tray inventory check | Muted lighting on dealer antenna |
| System Testing | Chip tray inventory testing | Assumes chip tray inventory is being actively tested during table close | Indication of permanent loss/alarm across all antennas; muted indication of flicker |
| Marketing Indicators | Marketing promotion such as a promotion or tournament is active or available on a table | A table is configured as part of an active marketing promotion | Special program-specific lighting scheme like a chase scheme on table in idle state |
| | Player is rated/unrated | Player has self-identified as a member of the casino loyalty program or alternately is playing anonymously | Special color for rated players versus anonymous players between games during open gaming sessions |
| | Player tier | Player's "status" in loyalty program | Outline around bet spot shows player tier by color |
| | Player eligible for tier advancement | Player is near to leveling up within a loyalty program | Outline around bet spot that shows player tier pulsates |
| | Player earns personal badge | Player earns an achievement badge within a personal promotion or tournament | Celebration lighting scheme on player-specific bet spots |
| | Player achieves personal best | Player achieves personal best within a personal promotion or tournament | Celebration lighting scheme on player-specific bet spots |
| | Player is on leaderboard | Player occupies a spot on promotion or tournament leaderboard | Outline around bet spot flashes |
| | Lucky chip in action somewhere on table | Lucky chip activated on a table | Alternating lighted checkerboard pattern on table |
| | Lucky chip in action on a specific bet spot | Lucky chip activated on a bet spot | Pulsating light on bet spot with Lucky Chip |
| | Player wins a Lucky Chip or other bonus | Player receives a bonus payout | Celebration lighting scheme on player-specific bet spots |
| | Player is entered in tournament | Player enters tournament on table | Confirmation light at time of check in |
| | Player is tournament leader | Player is in the lead during a tournament | Player bet spot lights up with higher intensity than other tournament entrants' bet spots |
| | Player wins tournament round | Player wins the round of a tournament | Celebration lighting scheme on player-specific bet spots |
| | Player is tournament winner | Player wins final tournament round | Celebration lighting scheme on player-specific bet spots |

Figure 4:
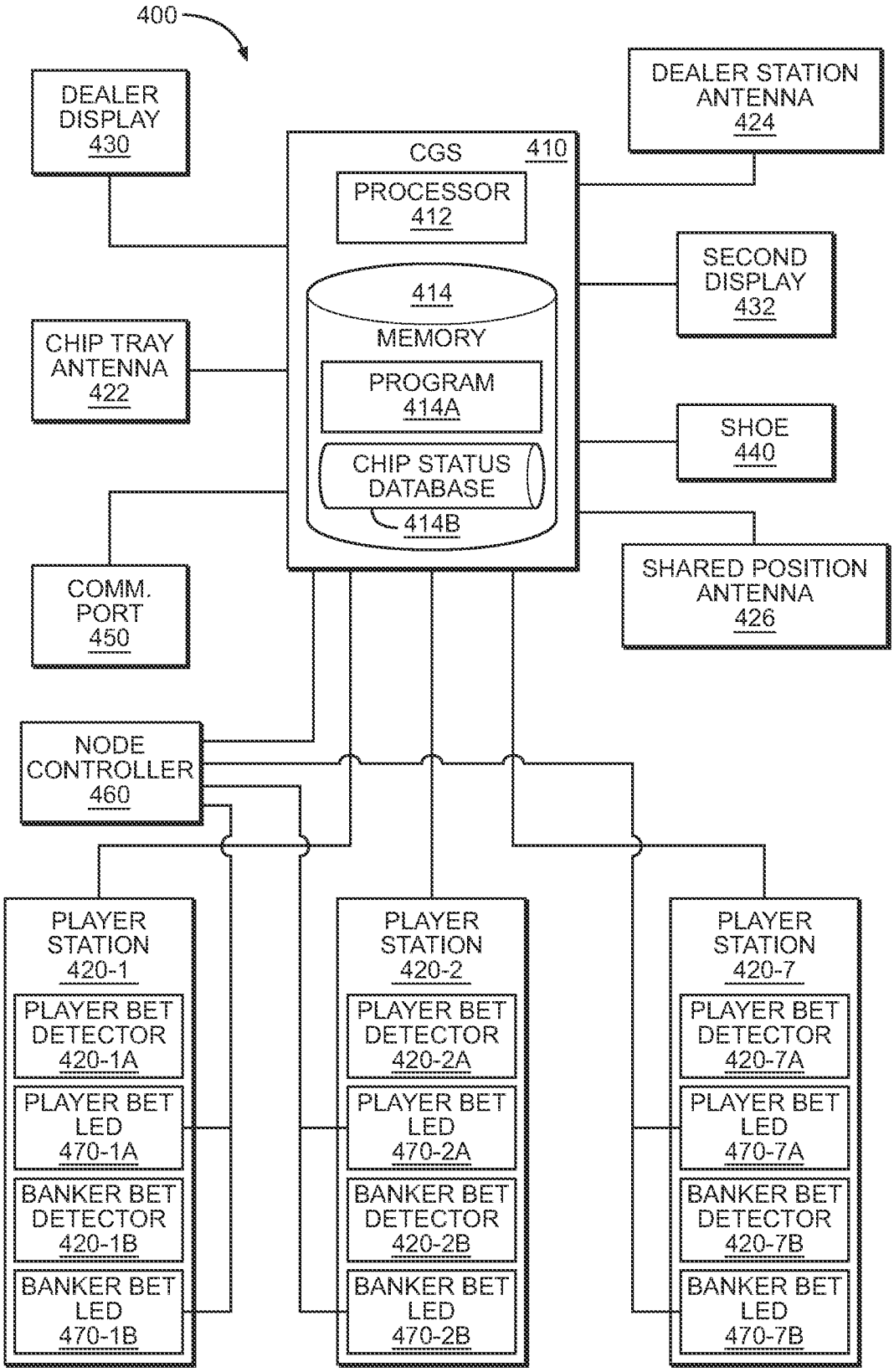
FIG. 4 illustrates a block diagram of a table system operable to facilitate at least some embodiments described herein.

Referring now to FIG. 4, illustrated therein is a block diagram of a table system 400 consistent with some embodiments described herein. The table system 400 may comprise, for example, a table system 120 of FIG. 1 and/or any of the tables 200A-200B (FIGS. 2A and 2B) and tables 300A-300C (FIGS. 3A-3C). The table system 400 may be implemented as a system controller, a dedicated hardware circuit, an appropriately programmed computer which is a component or peripheral device of a table for facilitating a card game, or any other equivalent electronic, mechanical or electro-mechanical device.

The table system 400 comprises a CGS 410, which includes at least one processor 412 (e.g., one or more INTEL® PENTIUM® processors). The CGS 410 further includes a memory 414. The memory 414 may comprise, for example, an appropriate combination of magnetic, optical and/or semiconductor memory, and may include, for example, Random Access Memory (RAM), Read-Only Memory (ROM), a compact disc, tape drive, and/or a hard disk. The memory 414 may comprise or include any type of computer-readable medium.

The memory 414 may store a program 414A for controlling the processor 412. The processor 412 may perform instructions of the program 414A, and thereby operate in accordance with at least one embodiment described herein. The program 414A may be stored in a compressed, uncompiled and/or encrypted format. The program 414A may include program elements that may be necessary or desirable, such as an operating system, a database management system and "device drivers" for allowing the processor 412 to interface with computer peripheral devices (e.g., an RFID-enabled chip tray, an electronic shoe, a camera, one or more LED components 470, any of which may provide data to the processor 412). Appropriate program elements are known to those skilled in the art, and need not be described in detail herein. In accordance with some embodiments, program 414A, a subroutine or module of program 414A or another program stored in memory 414 (or otherwise accessible to processor 412) may comprise instructions for applying at least some of the RFID component functionalities or the LED component functionalities described herein (e.g., coordinating the updating of LED components with the polling of RFID components, determining whether a lighting effect at an LED component should be updated based on data received from an RFID or other detecting component, determining which lighting effect to implement at an LED component based on current game state or data received from one or more detecting components). Process 600 (FIG. 6) comprises a distinct example of one subroutine or process that may be stored in memory 414, such as a part of program 414A.

The term "computer-readable medium" as used herein refers to any medium that participates in providing instructions to processor 412 (or any other processor of a device described herein) for execution. Such a medium may take many forms, including but not limited to, non-volatile media, volatile media, and transmission media. Non-volatile media include, for example, optical or magnetic disks, such as memory 414. Volatile media include dynamic random access memory (DRAM), which typically constitutes the main memory. Transmission media include coaxial cables, copper wire and fiber optics, including the wires that comprise a system bus coupled to the processor 412. Transmission media can also take the form of acoustic, electromagnetic, or light waves, such as those generated during radio frequency (RF), microwave, and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Various forms of computer readable media may be involved in carrying one or more sequences of one or more instructions to processor 412 (or any other processor of a device described herein) for execution. For example, the instructions may initially be borne on a magnetic disk of a remote computer. The remote computer can load the instructions into its dynamic memory and send the instructions over a telephone line using a modem. A modem local to a table system 400 may be operable to receive the data on the telephone line and use an infrared transmitter to convert the data to an infrared signal. An infrared detector can receive the data carried in the infrared signal and place the data on a system bus for processor 412. The system bus may carry the data to a main memory, from which processor 412 may retrieve data and execute instructions. The instructions received by main memory may optionally be stored in memory 414 either before or after execution by processor 412. In addition, instructions may be received via communication port 450 as electrical, electromagnetic or optical signals representing various types of information. According to some embodiments of the present invention, the instructions of the program 414A may be read into a main memory from another computer-readable medium, such from a ROM to RAM. Execution of sequences of the instructions in program 414A may cause processor 412 to perform at least some of the functions described herein. In alternate embodiments, hard-wired circuitry may be used in place of, or in combination with, software instructions for implementation of at least one embodiment described herein. Thus, embodiments described herein are not limited to any specific combination of hardware and software.

The memory 414 may also store at least one database, such as chip status database 414B. In some embodiments, some or all of the data described herein as being stored in the database 414B may be partially or wholly stored (in addition to or in lieu of being stored in the memory 414 of the table system 400) in a memory of one or more other devices, such the table game server 110 (FIG. 1). In accordance with some embodiments, the chip status database 414B may store chip identification data and/or chip status data (e.g., denomination, unique chip identifier, chipset identifier, gaming establishment identifier, chip value, player identifier associated with chip identifier, validity of chip, etc.). In some embodiments, the memory 414 may store additional data regarding movement, location or wagering activity which has occurred on the table. For example, chip movement history (e.g., an indication of which antennas or table bet positions a particular chip has been acquired at, a time at which it was acquired at a particular antenna, a time at which it was determined to no longer be at that antenna, etc.) may be stored (e.g. for determining shared bets). In some embodiments, a history of chip movements may be stored (e.g., in a file-based archive log) on another device (e.g., in a memory of table game server 110 of FIG. 1).

The CGS 410 is operable to communicate with a plurality of electronic components of the table system 400, including (i) a plurality of player station antennas at a plurality of player stations 420-1 through 420-7; (ii) a chip tray antenna 422; (iii) a dealer station antenna 424; (iv) a shared position antenna 426; (v) a dealer display 430; (vi) a second display 432; (vii) an electronic card shoe or card dispensing mechanism 440; (viii) a communications port 450 (e.g., for communicating with one or more other devices); (ix) at least one node controller 460 (which, in turn, is operable to communicate with a plurality of LED components 470, such as LED integrated circuit strips, 470A-1A and 4701-1B at player station 420-1, 470-2A and 470-2B at player station 420-2 and 470-7A and 470-7B at player station 420-1. The CGS 410 and the other components with which it is operable to communicate with may each be, for example: (i) located entirely within a single computer or other device; or (ii) connected to each other by a remote communication medium, such as a serial port cable, telephone line or radio frequency transceiver. In some embodiments, the table system 400 may comprise one or more devices that are connected to a remote server computer for maintaining databases.

The dealer display 430 may comprise, for example, one or more displays such as display 340 and/or display 322 of FIGS. 3A-3C. The second display 432 may comprise, for example, a display for displaying historical outcomes or other game information to a player (e.g., a trend board, such as described with respect to display 350 of FIGS. 3A-3C). The dealer display 430 may output information such as (i) prompts for how much should be collected from players in commission or losing wagers (e.g., for each player position involved in the hand); (ii) prompts for how much should be paid out to players for winning wagers (e.g., for each player position involved in the hand); (iii) tray variance or out-of-balance alerts, informing the dealer of missing chips from the RFID-enabled chip tray; and/or (iv) other information regarding a status of the game, including information regarding a status of one or more wagers or RFID-enabled chips being used on the table. In some embodiments, one or both of the displays 430 and 432 may include or have associated therewith its own processor, memory and program (and may be operable to communicated data to and/or from the CGS 410). Either of the display devices 430 and 432 may comprise, for example, one or more display screens or areas for outputting information related to game play on the gaming system, such as a cathode ray tube (CRT) monitor, liquid crystal display (LCD) screen, or light emitting diode (LED) screen. In some embodiments, either of the display devices 430 and 432 may comprise a touch screen.

In some embodiments, LED components may be located in areas of the table other than player station areas. For example, in one embodiment a set of LED components may be located at a dealer area (e.g., within proximity to the dealer station antenna 424) and/or at a shared position or common bet area (e.g., within proximity to shared position antenna 426) or simply in a general area of the table that is not for placing a wager or wagering chips. In such embodiments, the node controller 460 may be operable to also communicate with, and send instructions to, such additional LED components.

As described herein, in some embodiments an RFID-enabled chip tray may comprise one or more antennas for reading information from RFID-enabled chips placed in the chip tray. In such embodiments, the CGS 410 is further operable to communicate with the one or more chip tray antenna(s) 433. The one or more antenna(s) 422 may be operable to read data from one or more chips placed within a chip tray (e.g., chip identifier, chip set identifier, chip denomination, etc.).

As shown in FIG. 4, in some embodiments the CGS 410 is further operable to communicate with a shared position antenna 426, which comprises at least one antenna on a shared or common betting area for recognizing chips placed (and removed from) the shared or common betting area. In some embodiments, CGS 410 may receive from an antenna 422 data regarding chips placed on a common betting area and determine, based on this data and additional data stored in memory (e.g., a player identifier or last player position associated with the chip that has now been acquired at the shared position antenna 422) that a particular bet has been made by a particular player or for a particular player position. As described above, in some embodiments the shared position antenna may have associated therewith its own set of LEDs.

As also shown in FIG. 4, in some embodiments the CGS 410 is further operable to communicate with a plurality of antennas at player positions or stations included on the table 400. As described with respect to FIGS. 2A-2B and 3A-3C, in some embodiments each player position of a table may have a corresponding Player bet area and a Banker bet area and each such area may have associated therewith its own antenna for determining that a chip has been placed with its area. The table system 400 illustrates a plurality of player positions 420-1 through 420-7 (e.g., for seven (7) player positions on a baccarat table) as each having two antennas associated therewith: (i) a Player bet antenna 420-1A and a Banker bet antenna 420-1B at player station 420-1; (ii) a Player bet antenna 420-2A and a Banker bet antenna 420-2B at player station 420-2 and (iii) a Player bet antenna 420-7A and a Banker bet antenna 420-7B at player station 420-7 (with similar Player and Banker antennas being part of the system for player stations 3, 4, 5 and 6 (not shown for brevity)).

Each antenna of table 400 may be uniquely identifiable by, for example, (i) a unique identifier associated therewith, and (ii) an identification of a port or other component of the table associated with the antenna (e.g., the port into which the antenna is plugged into may have a unique identifier associated therewith) and such unique antenna identifier may be transmitted to or recognized by the CGS 410 when chip information regarding a chip acquired by a respective antenna is transmitted to CGS 410 or otherwise acquire by CGS 410. In some embodiments, CGS 410 may be programmed to determine which player position and which betting area within the player position the chip has been placed within based on an identifier of an antenna from which wagering data is acquired.

In some embodiments, a single player station 420 may include antennas associated with two or more players. For example, one antenna may be intended for a first player playing the game at the table and another antenna for a second player (e.g., a "back bettor") who may be betting along with or in association with the first player, either remotely or from essentially the same location, but whose chips and betting activity is to be separately tracked. In some embodiments, the chip status database 414B may store detailed data with information regarding chips identified at a table, such details being associated with a chip identifier of each chip for which data is stored (e.g., chip value, chip denomination, chipset identifier or other indicator of a category or characteristic associated with a chip). Storing such data at the table may allow for faster RFID scanning, since the system will not need to obtain a lot of data every time a chip is acquired or recognized by an antenna of a table (e.g., only the chip identifier may be necessary and additional information may be looked up by the system based on the chip identifier from a local database or memory).

In accordance with some embodiments, and as illustrated in FIG. 4, each of the player stations (and, in particular, each of the banker bet spot and the player bet spot at each of the player stations) is associated with a respective LED component that is located under the felt of the table at the player stations (the light of the LED component being visible through the felt). An LED component, as the term is used herein, may refer to either a single LED or a set (e.g., a strip) of LEDs. As illustrated in the example system 400 of FIG. 4: (i) player station 420-1 includes LED component 470-1A at the Player bet spot and LED component 470-1B at the Banker bet spot; (ii) player station 420-2 includes LED component 470-2A at the Player bet spot and LED component 470-2B at the Banker bet spot; and (iii) player station 420-7 includes LED component 470-7A at the Player bet spot and LED component 470-7B at the Banker bet spot.

CGS 410 is also in communication with a shoe 440, which may include an electronic card shoe or card dispensing device. The electronic shoe or card dispensing device 440 may be an intelligent shoe such as the IS-T1™ and IS-B1™ or the MD1, MD2 sold by SHUFFLE MASTER or other similar device. The shoe 440 may be able to determine which cards are being dealt to which player station, through RFID technology, image recognition, a printed code on the card (such as a barcode), or the like. In some embodiments, the shoe 440 may be operable to identify information about the cards being dealt or remaining in the shoe, such as a suit or value of a given card. The embodiments described herein are not dependent on any particular technique used to recognize cards dealt in a card game (or cards remaining as available to be dealt). Further information about intelligent shoes that may be incorporated into system 400 may be found in U.S. Pat. Nos. 7,575,234; 7,950,661; 5,941,769; 7,222,852 and 7,029,009, all of which are incorporated by reference in their entireties and U.S. Patent Application Publications 2005/0026681; 2001/7862227; 2005/0051955; 2005/0113166; 2005/0219200; 2004/0207156; and 2005/0062226 all of which are incorporated by reference in their entireties. In place of an intelligent shoe, cameras, such as may be used with pattern recognition software to detect what cards have been dealt to what player stations and what chips have been wagered at particular player stations. One method for reading data from playing cards at table games is taught by German Patent Application No. P44 39 502.7. Other methods are taught by U.S. Patent Application Publication 2007/0052167 both of which are incorporated by reference in their entirety.

The CGS 410 is also operable to communicate with a dealer station antenna 424. The dealer station antenna 424 comprises one or more antennas placed in a dealer area of the table 400. The dealer station antenna 424 may be operable to detect RFID-enabled chips which have been placed within its acquisition area, such as chips the dealer places in the area for recognizing by the system prior to placing them into the dealer tray or paying them to a player.

An automated RFID-enabled table such as illustrated in FIGS. 2A-2B, FIGS. 3A-3C and/or FIG. 4 may render various the tasks and record keeping associated with game play at the table much more efficient and less prone to error or fraud. For example, as described herein and according to some embodiments, RFID components such as antennas may be deployed in a gaming table for the purposes of (i) determining a wager amount associated with a player position; (ii) determine a wager type associated with the wager amount and/or player position; (iii) determine modifications to wagers during certain game stages; (iv) determine results of hands or other game events; (v) calculate payouts, losses and commissions accurately and efficiently; and (vi) allow for automated triggering, identification and/or indication of bonus events based on player wagers, player identifiers, chip identifiers or other factors. For example, in accordance with some embodiments, the CGS 410 may operate to receive chip data from various RFID antennas (e.g., by polling such antennas in accordance with a schedule and/or game events), determine a game result (e.g., based on chip data and/or card data) and control the output of information to players and/or dealers via one or more displays of the table (e.g., via a dealer display 430 and/or a second display 432).

In accordance with some embodiments, an RFID antenna as is described with respect to various embodiments and Figures herein (including FIGS. 2A and 2B and FIG. 4) may comprise an RFID component which utilizes Phase Jitter Modulation (PJM) technology to acquire data from passive RFID tags within RFID-enabled wagering chips utilized on the table. As described elsewhere herein, a passive RFID tag does not contain a battery or other internal power source. It is powered by the antenna, which attempts to read or acquire the information of the RFID tag. The antenna, when it is ready to read data from an RFID tag (or determine whether an RFID tag is present within its readable vicinity) sends out radio waves. In accordance with some embodiments, the CGS manages the antennas and manages when each antenna should be activated to read data. When a radio wave from an antenna reaches an RFID tag (an RFID tag of an RFID-enabled wagering chip, for purposes of the embodiments described herein), a coiled antenna within the RFID tag forms a magnetic field. The RFID tag draws power from it, energizing the circuits in the tag. The tag then sends the information encoded in the tag's memory to the reader or antenna which, in turn, send the data to the CGS. U.S. Pat. No. 5,153,583 to Murdoch, issued on Oct. 6, 1992 and entitled TRANSPONDER and U.S. Pat. No. 8,810,371 to Murdoch et al, issued on Aug. 19, 2014 and entitled ANTENNA DESIGN AND INTERROGATOR SYSTEM each describe example systems and methodologies for reading data from a passive RFID tag using a suitable RFID antenna or interrogator which may be utilized in some embodiments described herein. The entirety of each of these patents is incorporated by reference herein, particularly the descriptions of how a magnetic field may be generated when an interrogator or antenna reads data from an RFID tag.

In accordance with some embodiments, the CGS 410 may further be operable to communicate with a node controller 460, which may be another component of the table system 400. The node controller 460 may, in turn, be operable to communicate with a plurality of LED components, such as LED components 470 of the player stations 420 (any number of node controllers and LED components may be used other than what is illustrated in FIG. 4 and the placement of the LED components on a table is not limited to placement within player stations).

In accordance with some embodiments, each LED component 470 may comprise an LED light strip (e.g., in the form of a flexible LED tape or ribbon light) which may comprise a flexible circuit board populated by surface mounted LEDs. In accordance with some embodiments, each LED on a light strip may include its own chip and be individually addressable or controllable (e.g., each light may be turned on and off, or be instructed to change from one color to another, individually). In other embodiments, non-addressable LED light strips (e.g., one for each bet spot or other area for which light functionality is desired) may be utilized), such that each strand uses the same address and all LEDs on it show the same color and/or are turned on and off at the same time. In such embodiments, shorter LED light strips may be used for each area of the table for which LED lighting functionality is desired, rather than longer strips which encompass distinct multiple areas for which LED lighting functionality is desired (as is illustrated in the example of FIG. 2B, in which design a single LED light strip encompasses multiple bet spots for which distinct LED lighting functionality may be desired).

One example of an LED light strand that may be utilized for at least some embodiments described herein is an intelligent control LED which comprises at least one control circuit and allows for multiple colors such as red, blue and green (and RGB addressable LED). For example, Worldsemi™ manufactures suitable light sources, such as their WS812 Intelligent control LED integrated light source. In this particular light source, each LED has an integrated circuit (IC) which includes a shift register and a pulse-width-modulation (PWM) circuit that translates the data shifted into the IC into pulses that produce a Red Green Blue (RGB) color output.

Applicant has recognized there are opportunities to take advantage of the various data being acquired by the CGS from the RFID antennas or other detecting component (e.g., imaging component) of the table in order to output or convey information to game participants in a more understandable and/or entertaining manner. In particular, Applicant has recognized that information may be output to players using lighting on the table, such as lighting that is placed underneath the covering of the table and shines through that covering to highlight or convey certain information. For example, different game areas (e.g., bet spots) of the table may be lit up to convey information and different colors and/or effects of light may be utilized to convey different information, as described herein. In one particular embodiments, Applicant has recognized that intelligent LED components may be utilized to convey information. In accordance with some embodiments, the information that is so conveyed via lighting is information that is acquired from RFID components or other detecting components of the table. However, the opportunities provided by such RFID or other detecting components and the data that is gathered via the RFID or other detecting components also present certain challenges to the use of LED lighting. Examples of such challenges include, without limitation: (i) minimizing or eliminating conflicts or interference between the RFID or detection functions of a CGS (e.g., polling of the RFID components in order to obtain or verify wagering data) and the LED functions for controlling the LED components of the table; and (ii) minimizing or eliminating electrical interference between RFID or other detecting components and the LED components of the table (e.g., between the magnetic field of the RFID components of a table and the LED components as well as minimizing any negative impact to the RFID operations of the table due to any electrical state changes in the LED components).

With respect to challenge (i) and as described herein, the CGS of a table receives data from the RFID or other detecting components that may be useful to identify certain events, statuses or information and that may in turn be beneficial to convey to game participants using LED components. Examples of the foregoing include, without limitation, which bet spots have had wagers placed therein, which wager is the highest wager, which wager is a winning wager, whether a chip placed on a bet spot is a "lucky chip" and qualifies the owner for a benefit, whether an antenna at a bet spot is not working correctly, whether a signal from an RFID chip is flickering or inconsistent, etc. In accordance with some embodiments, the CGS controls the polling of the antennas, such that is manages when particular antennas of the table read data from RFID tags within their ranges, as well as analyzes the data received via such antennas to track wagers, verify payouts made and payments collected, verify the functioning of the antennas and the signals received from RFID tags, etc. In accordance with some embodiments, given the wagering and antenna polling data and management that the CGS has access to, the CGS may also be operable to determine when and how particular LED components of the table should be updated or the status of various lights modified to reflect game events or implement certain lighting effects. In accordance with some embodiments, it may be desirable to separate the RFID functions or data detection functions performed by the CGS from the LED functions. Such separation of the two types of functions may facilitate accurate, efficient and smooth game play by continuing to reliably acquire or receive data from RFID or other detecting components while, in parallel, managing the updating of LED components such that any changes to the light statuses are timely, accurate based on game events and visually pleasing, Examples of RFID functions or other data detecting functions that may be performed by the CGS include, without limitation, managing the polling of RFID antennas or other detecting components, being available to receive signals from the RFID antennas or other detecting components, performing calculations or analysis on received data in order to identify alert events and determine expected payout and payment amounts for a current game event, output data to a dealer and/or game participants (e.g., informing the dealer of correct payout or commission amounts) and/or verifying that correct payouts have been made and correct payment have been collected amounts have been made by a dealer. Examples of LED functions include, without limitation, transmitting instructions to at least one LED component of a table to turn specified LED lights on, off, to the desired color or with the desired lighting effect.

With respect to challenge (ii), Applicant has recognized that detecting components such as RFID components of a smart table such as described herein generate a magnetic field during certain events, such as when an antenna of the table is energized and reading an RFID tag of a wagering chip placed within a reading range of the antenna. The magnetic field generated around the RFID tag by the antenna during the "reading" process may, depending on the power of the antenna, be powerful enough to swamp or interfere with other signals and/or circuits within its area of influence. The components of a smart gaming table are, by necessity due to the surface area of the table, placed relatively close to one another. Thus, the magnetic field generated by an antenna when reading an RFID tag may be strong enough to interfere with signals being sent to/from LED components that are near the RFID tag and/or interfere with the circuit operations of the LED components. For example, referring again to FIG. 2B, assuming the Banker bet spot antenna at player position 210*a* is currently activated and reading data from any RFID-enabled chips on that bet spot, the magnetic field generated within the vicinity of this bet spot may interfere with signals being sent to the section of the LED component 240A that is under the Banker bet spot of player position 210*a*. Accordingly, in some embodiments the timing of signals sent to an LED component (or certain sections or lights of an LED component) may be coordinated with the timing of activation of RFID antennas so as to avoid sending signals to a section or light of an LED component at a time when an RFID antenna within a certain vicinity of the LED component is active (e.g., reading data from RFID tags within its range, communicating with CGS 410) or generating a magnetic field (or, in an embodiment in which the strength of the field may vary, when the magnetic field is not at its most powerful).

As noted, changes to the electrical state of an LED component may negatively impact the operations of a nearby RFID component. For this additional reason, the timing of updating an LED component should be managed such that it is performed at a time when the nearby RFID component(s) of the table are not being polled or are not actively reading data from nearby RFID tags.

Further with respect to challenge (ii), Applicant has also recognized that the electrical activity of an LED component (e.g., an LED circuit of a light strip) that is currently active (e.g., an LED light is blinking, dimming or performing an operation that involves high-speed LED circuit changes) has the potential for interfering with the response of a nearby RFID tag in a wagering chip that is being read at the time. The electrical activity of an LED circuit (e.g., the electrical currents the circuit produces) when it is in a highly active state has the potential to produce noise that effectively jams or interferes with the response of an RFID tag being read.

Accordingly, at least some embodiments described herein are responsive to the various challenges described above. For example, at least some embodiments provide for a smart table system that coordinates the polling of RFID antennas and electrical activity of LED components. Such coordination is intended to minimize the possibility that high speed visual LED changes or other electrical activity at LEDs that can result in electrical currents may potentially block or interfere with an RFID tag effectively responding to the antenna. The coordination is also intended to minimizes the negative impact that the powering field of an antenna can have on nearby LED circuitry.

Additionally, in at least some embodiments the smart table system separates the RFID operations (e.g., managing the polling of RFID antennas) from the LED operations (e.g., sending signals or instructions to LED circuits, instructing a change in a status of the LED circuit) such that the CGS is focused mainly on the RFID operations and at least one node controller which serves as an intermediary between the CGS and the LED components is focused on transmitting signals or instructions to the LED components. FIG. 4 illustrates an example system that can be utilized to achieve this separation of functions.

Referring again to FIG. 4, the diagram of example table system design 400 illustrated therein is an example of one table system design that addresses some of the challenge of minimizing disruptions to the primary responsibilities of the CGS (e.g., receiving wagering data, calculating payouts and payments to be made based on game event outcome, verifying that the correct payouts have been made and correct payments have been collected by a dealer). In particular, system 400 includes a node controller 460 that is operationally positioned between the CGS 410 and the plurality of LED components 470, which are located at respective player stations 420-1 through 420-7. Although only one node controller 460 is illustrated in FIG. 4, a plurality of node controllers may be used if desired. In accordance with some embodiments, the node controller 460 performs the LED functions which involve sending signals or instructions to the LED components of the table, based on signals or instructions it receives from the CGS. In some embodiments the node controller 460 may also be programmed to perform additional functions (some of which may be described herein as being performed by a CGS, such as CGS 410), such as determining that a status of one or more LEDs should be changed (e.g., a different lighting effect should be adopted by the LED(s)) based on data received from one or more detecting components and/or information stored in a memory.

In accordance with some embodiments, provided herein is a gaming table system design (as well as methods and software for operating such) that manages the RFID and LED operations of a gaming table such that the main controller of the table (i) determines, for at least one RFID component of the table that is located in a first area of the table, that the RFID component has finished a first type of RFID operation; and (ii) transmits, upon such determination, to a node controller of the table, an update command for at least one LED component that is located in the first area of the table. In accordance with one embodiment, the update command may include data such as an indication of how the at least one LED component is to be updated (e.g., which bet spots are to be lit up, based on wagering data acquired by the main controller). In accordance with some embodiments, the node controller translated the data received from the main controller into more detailed instructions or signals and sends these to the at least one LED component. In this manner, the LED operations performed by the main controller are limited and minimize any potential for interruption to the RFID operations of the main controller. In other embodiments, the main controller of the table communicates with the at least one LED component directly. In accordance with some embodiments, the LED circuits of the at least one LED component are held in a steady, low power, state between updates from the node controller and/or main controller.

In some embodiments, the coordination of when to send update instructions to an LED is performed by the node controller 460 rather than by the CGS 410. For example, the CGS may determine that one or more LEDs should be updated or the lighting effect being output by such one or more LEDs should be modified, and may send appropriate instructions to the node controller 460 to update or change the status of the LEDs. The node controller 460 may then hold such instructions in abeyance or in a queue until such a time as it determines that any polling or energizing of RFID or other detecting components near to the LED(s) that are to be updated is complete (at which time the node controller will forward or transmit instructions to the LEDs).

As one illustrative example and referring to the embodiment of FIG. 2B, a CGS of the table 200B may send an LED update command to a node controller (which, in accordance with some embodiments, may serve as an intermediary between the CGS and the LED light strips, to minimize the LED operations carried out by the CGS) for all player-banker antennas, just after the last antenna of the player stations has finished reading RFID tags within its range (e.g., just after the antenna pair 210*g* are polled, assuming the antenna pairs are read from 210*a* to 210*g*). In accordance with some embodiments, once the player station antennas are polled, the system moves on to poll antennas at a different part of the table (e.g., dealer area antenna 220A and/or other antennas such as a tie, pair shared position or chip tray antennas). Thus, this may be an opportune time during a game to send commands to LED circuits at the player positions because any interference with RFID activity at the player positions is minimal or non-existent. It should be noted that, in some embodiments, the polling of antennas is done in accordance with a predetermined schedule or scheme (e.g., each antenna is polled in a rotating manner) that the CGS and/or node controller is aware of. Thus, the CGS or node controller may be operable to insert the commands to the LED components based on this predetermined schedule or scheme. In other embodiments, which antennas are being polled at any given time may be dynamically determined based on game events or the stage of the game being played. Since, in at least some embodiments, the CGS will be controlling the polling and aware of which antennas are being polled when, the CGS may dynamically determine the most appropriate time to send a command to the node controller (or LED components directly, depending on the implementation).

Figure 5A:
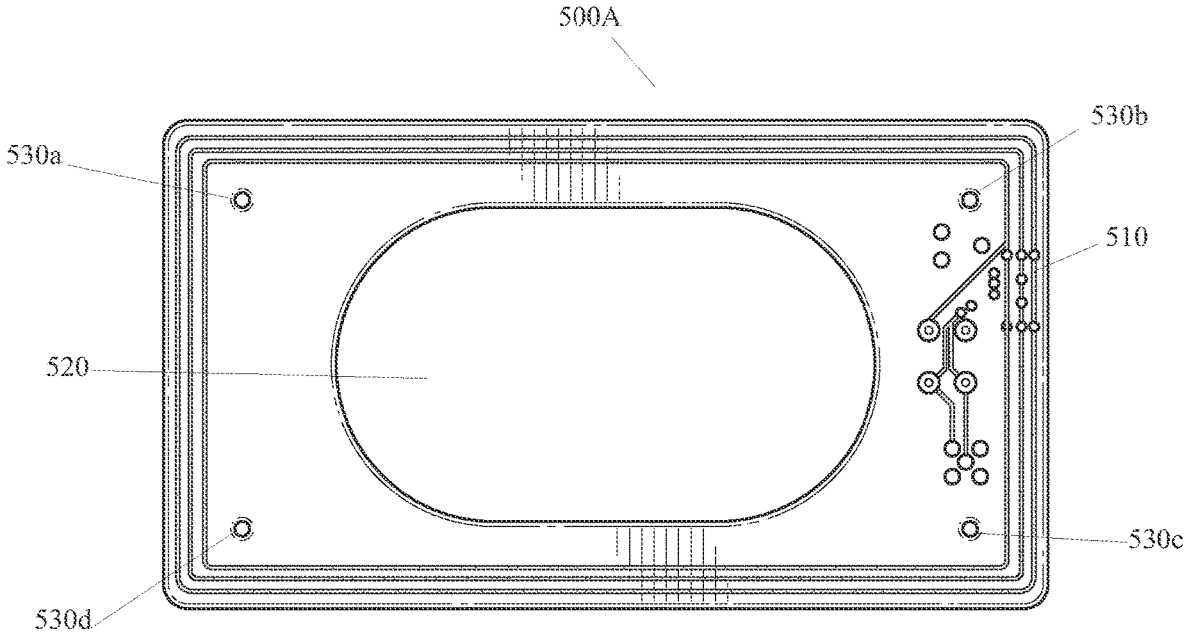
FIGS. 5A and 5B illustrate a top planar view of some example electrical components that may be utilized in a table system operating in accordance with at least some embodiments described herein.
Figure 5B:
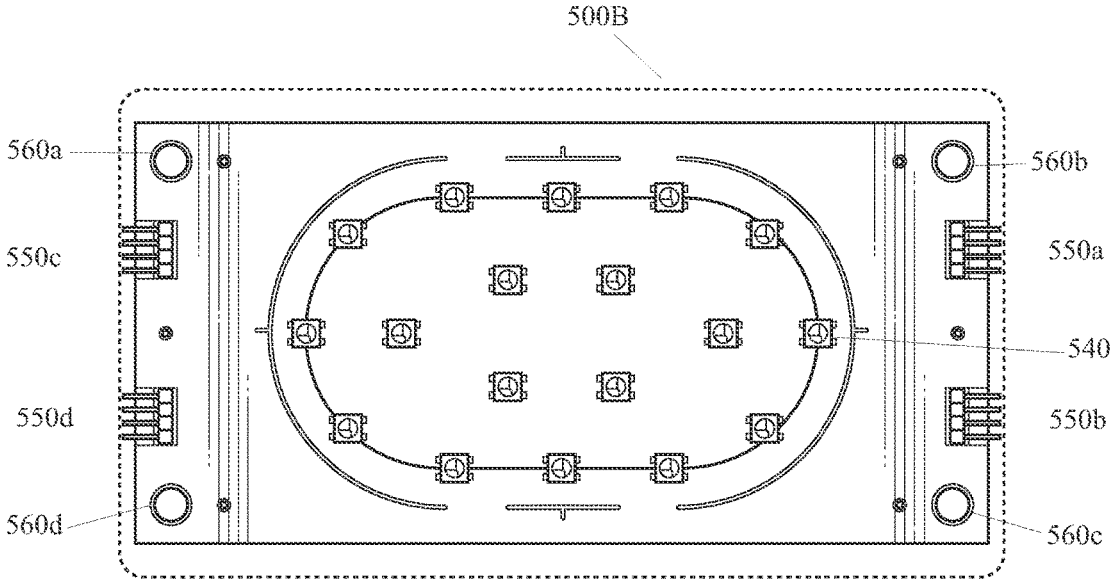

Referring now to FIGS. 5A and 5B, illustrated therein is an example of an alternate solution or table system design that is intended to minimize the interference between the RFID components and the LED components at a given game area (e.g., bet spot) of a table. In accordance with some embodiments, provided herein is a smart gaming table that is designed in a manner intended to minimize the generation of a magnetic field or interference between magnetic or electrical fields generated by the RFID components and LED components of the table. For example, a mounting component of the table onto which such components are mounted may be made from a material intended to minimize such interference (e.g., aluminum). In another example, for each bet spot the LED components may be placed on a first substrate (e.g., first circuit board) and the RFID components may be placed on a second substrate (e.g., second circuit board) and the two substrates may be attached using standoffs or other mounting hardware mechanisms which provide for a space (e.g., a ½" to a 1" space) between the first substrate and the second substrate. In one embodiment the second substrate is constructed with a hole in its center and the first substrate is constructed with the LED components placed in an area that fits within the hole, such that when the first substrate and the second substrate are mounted to the mounting component of the table they are mounted such that the second substrate is directly below the first substrate at a particular bet spot such that the RFID components surround the LED components, with the space between the two. FIGS. 5A and 5B illustrate one example implementation of such an embodiment.

Referring to FIG. 5A in particular, illustrated therein is a front of an example circuit board 500A that has an RFID antenna etched upon it. In accordance with one example embodiment, the RFID antenna 510 is etched along the perimeter of the circuit board 500A, in a rectangular shape. The circuit board 500 has an oval-shaped hole 520 in its center. The circuit board 500 further includes four small mounting holes 530*a*-530*c*, one at each corner, via which the circuit board may be attached to a mounting surface comprising the table (e.g., using mounting hardware, which may be threaded mounting hardware in some embodiments). The circuit board 500A may be akin to the second substrate in the two-board solution described above.

Referring to FIG. 5B, illustrated therein is a front of an example circuit board 500B that may be akin to the first substrate in the two-board solution described above. The circuit board 500B has eighteen (18) LEDs 540 placed thereon, which may in some embodiments be connected by a flexible electronic connector. The eighteen (18) LEDs 540 are configured in an oval shape that fits within the hole 520 of the first circuit board 500A. The second circuit board 500B also include four mounting holes 560*a*-560*d*, one at each corner, via which the circuit board may be attached to a mounting surface comprising the table (e.g., using mounting hardware, which may be threaded mounting hardware in some embodiments).

In accordance with some embodiments, the four mounting holes 530*a*-530*d* of circuit board 500A are lined up with the four mounting holes 560*a*-560*b* such that the two circuit boards may be mounted using the same four standoffs that also attach to or are located on a mounting surface comprising the table. In accordance with some embodiments, the circuit board 500B with the LEDs is mounted below the circuit board 500A, such that the LEDs 540 of the circuit board 500B can be seen through the felt of the table and through the hole 520 of the circuit board 500A, which may be mounted above the circuit board 500B. In some embodiments, the two circuit boards 500A and 500B are mounted on the standoffs such that there is some small space (e.g., ½" to 1") between the two, which space can further minimize any interference between the RFID components of circuit board 500A and the LED components of circuit board 500B.

It should further be noted that although an oval configuration is illustrated for the shape of the hole 520 (FIG. 5A) and the configuration of the LEDs 540 (FIG. 5B), the embodiments described herein are not limited to any particular shape.

It should be noted that both the first circuit board 500A of FIG. 5A and the second circuit board 500B of FIG. 5B may be dimensioned or sized such as to fit under the felt and within a particular bet spot of a baccarat or blackjack game table (e.g., underneath the felt and within a Banker bet spot or a Player bet spot at a given player position 310*a*-310*g* of FIGS. 3A-3C).

It should be noted that in the two-card solution illustrated and described with respect to FIGS. 5A and 5B, a system such as that described in FIG. 4 may not utilize a node controller 460. In embodiments in which a node controller 460 is not used, a CGS 410 may be operable to directly communicate with one or more LEDs 470. In other embodiments that use the two-card solution illustrated in FIGS. 5A and 5B, a node controller 460 may still be utilized to manage communications between a CGS 410 and one or more LEDs of the system.

Figure 6:
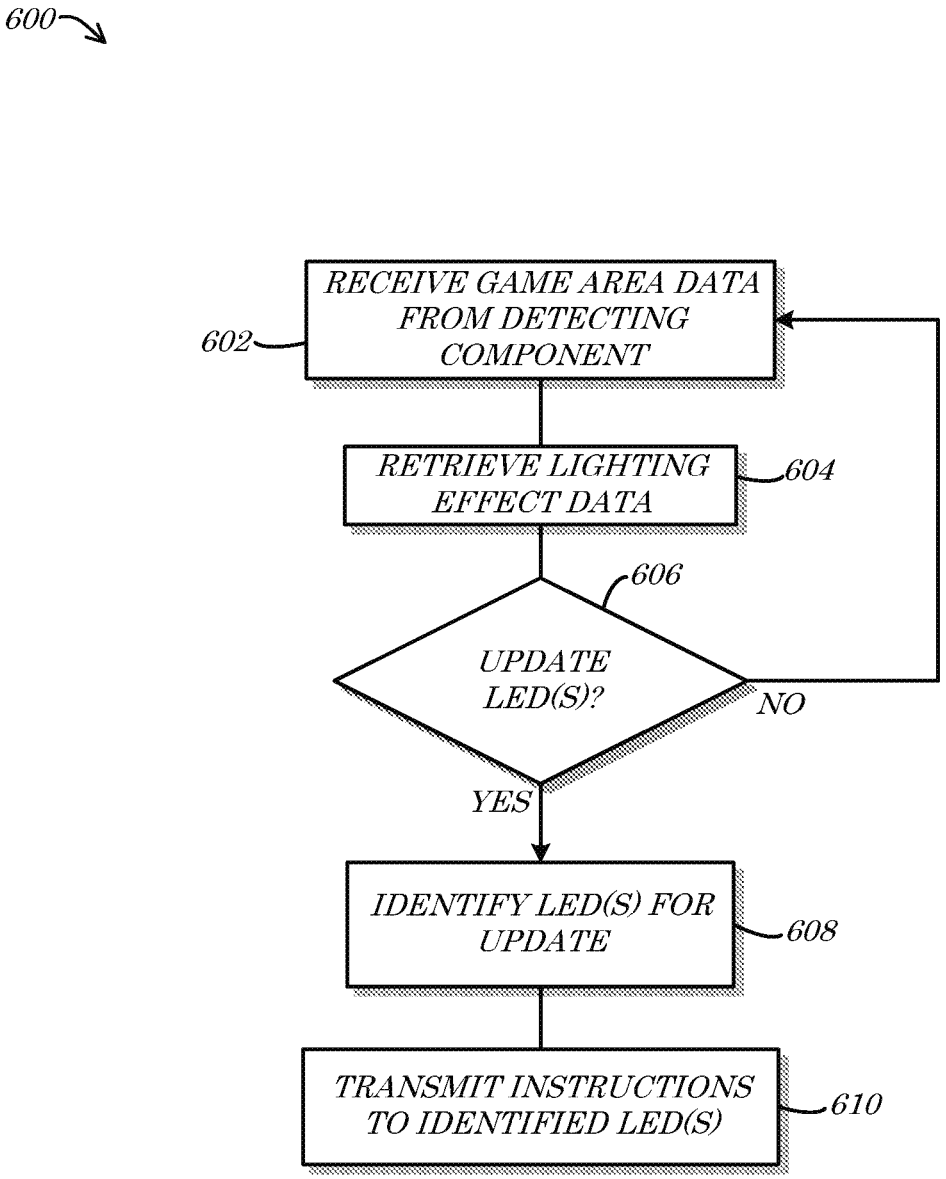
FIG. 6 illustrates a flowchart of one example process consistent with some embodiments described herein.

Referring now to FIG. 6, illustrated therein is an example process 600 that may be implemented in accordance with some embodiments described herein. Process 600 may be performed, for example, by at least one of a server device operable to facilitate game play on an electronic table system as described herein, by CGS 410 (FIG. 4) and/or by a node controller 460 (FIG. 4). It should be noted that additional and/or different steps may be added to those depicted and that not all steps depicted are necessary to any embodiment described herein. Process 600 is but one example process of how some embodiments described herein may be implemented, and should not be taken in a limiting fashion. A person of ordinary skill in the art, upon contemplation of the embodiments described herein, may make various modifications to process 600 without departing from the spirit and scope of the embodiments in the possession of applicant.

Turning now to FIG. 6 in particular, process 600 begins when data regarding a game area of a table system is received from a detecting component (602). The game area may comprise, for example, a bet spot of the table. The data may comprise, for example, data indicating information about a wager detected at the game area (e.g., a value of a wager, a timing of the wager, a modification to a previously detected value of a wager), data indicating information about a component of the table located within the game area (e.g., an error message regarding an RFID antenna or imaging device), data indicating information about a game element located at the game area (e.g., a status of an RFID wagering chip detected at the game area) or data indicating information about a player located near the game area (e.g., whether the player is a carded or identified player or an identifier associated with the player). In some embodiments the data in step 602 may be received in response to an interrogation, energizing or query of the detecting component in order to obtain the data while in other embodiments a "push" mechanism may result in the detecting component pushing the data to the controller or process that is receiving it (e.g., the detecting component may push the data to the controller or processor each time it receives new data or detects a change in data).

The lighting effect data or information is then retrieved or accessed in order to determine whether the data received in step 602 should result in a transmission of an instruction to an light component (e.g., LED) of the table (604). For example, a table or database such as that illustrated in Table 1 may be accessed or queried. In another example, a sub-routine or module that has programmed into it various queries or If-Then statements that are intended to determine whether one or more events or statuses of a game, gaming table component, game element or player has been detected that corresponds to a specific lighting effect has been identified.

In step 606 it is determined, based on the data received in step 602 and the information retrieved, accessed or otherwise determined in step 604, whether one or more lighting components or LEDs of the table should be updated or instructed to implement a specific lighting effect. In some embodiments, this determination may be based on additional data (data additional to that received in step 602). In some embodiments, this determination may include determining a current state or status of a game, table system component, game element or player and determining whether this current state or status differs from that previously determined (e.g., previously for the current game, game event or hand). In some embodiments, the determination to update or change a lighting effect being output by a particular LED or group of LEDs may only be made if there is determined to be a change from the previous state or status. In some embodiments, step 606 may comprise determining a current lighting effect, if any, currently being output by at least one LED and determining whether this should be changed or modified (e.g., to a different lighting effect) as based on at least the data received in step 602. In some embodiments, step 606 may comprise determining whether one or more potential events (e.g., as stored in a table or database, such as Table 1 described above) has occurred or is predicted to occur, based on at least the data received in step 602. For example, comparing the data received in step 602 to previously received data may allow the system to determine that a particular event has occurred (e.g., a player has increased his wager or a dealer has collected an incorrect commission amount) and thus identify that a particular potential event (E.g., an increase in a wager amount, a new highest wager amount or a commission error) has occurred and that an LED should be updated to output an indication of this event.

In accordance with some embodiments, the additional data on which the determination in step 606 is made is data earlier received (e.g., earlier in the current game or hand) from the same detecting component from which the data in step 602 was received. For example, the data received in step 602 may comprise an indication that at least one game element has been detected by the detecting component (thus indicating that a wager has been placed on the bet spot corresponding to the detecting component). This data may be compared to previous data received from the detecting component or a determination or conclusion drawn based on data previously received from the detecting component. For example, it may be determined whether the detection of the game element is new (i.e., has the wager on that bet spot been previously identified or is this an indication of a newly placed wager). The determination in step 606 may thus, in the present example, be a determination that an LED associated with that bet spot should be updated to indicate a newly recognized wager or, if the wager was previously detected and the LED already instructed to output the appropriate lighting effect to indicate a placed wager, that the LED does not need to be updated or instructed to update the lighting effect it is currently outputting.

In accordance with some embodiments, the additional data on which the determination in step 606 is made is data received (e.g., earlier in the current game or hand or essentially contemporaneously with the data received in step 602) from a different detecting component than the detecting component from which the data in step 602 was received. For example, one use of LED components described herein is to indicate to players the highest placed wager for a current game or hand. Thus, assuming for purposes of the present illustrative example that the data received in step 602 was an indication of a value or magnitude of a wager detected at the game area with which the detecting element from which the data in step 602 was received, step 606 may comprise comparing this value or magnitude of wager to that received from other detecting components at the table for the current game or hand in order to determine which bet spot has placed thereon the highest wager. The step 606 may then further comprise determining whether the bet spot that is determined to have on it the highest wager for the current game or hand was previously so determined in the current game or hand and, if it was, then the determination in step 606 may be that there is no need to update an LED component associated with that bet spot or any other bet spot (at least not in order to have the LED component of that bet spot indicate that the bet spot has the highest wager placed thereon).

In accordance with some embodiments, the additional data on which the determination in step 606 is made is data received (e.g., earlier in the current game or hand or essentially contemporaneously with the data received in step 602) from a different source other than a detecting component. For example, in accordance with some embodiments, some game elements (e.g., RFID wagering chips) may be associated in a memory (e.g., in a chip status database, such as chip status database 414*b* of FIG. 4) may correspond to one or more benefits to be provided to a player associated with the wagering chip(s) when the game element is used in a predetermined manner (e.g., when it is wagered). Thus, assuming for purposes of the present example that the data received in step 602 was an identifier of, or other data defining, a game element detected in a game area by a detecting component, step 606 may comprise accessing a memory storing such information on game elements corresponding to one or more benefits in order to determine whether the detected game element corresponds to the one or more benefits and, if it does, determining whether a current lighting effect being output by an LED component associated with the game area for which the data in step 602 was received, is appropriate (e.g., indicates that a wagering chip placed on the bet spot comprising the game area is associated with the one or more benefits or is a "lucky chip"). If it is determined that the lighting effect currently being output by the LED component is not appropriate, it may be determined in step 606 that an instruction should be transmitted to the LED to update the lighting effect being output.

If it is determined, in step 606, that a status of an LED should not be updated (e.g., that the current lighting effect being output by the LED is appropriate based on at least the data received in step 602 and does not need to be updated or modified), then process 600 returns to step 602 and data is again received from a detecting component. If, on the other hand, it is determined that at least one LED component does need to be updated (e.g., a lighting effect being output by the at least one LED component needs to be modified), then process 600 continues to step 608.

In step 608 it is determined which LED component(s) to update based on the determination in step 606. In some embodiments and circumstances, step 608 may be part of step 606. In other words, in some scenarios and depending on what type of data is received in step 602 and what event is determined to have occurred that warrants a change to a lighting effect currently being output by the LED component(s), determining in step 606 that the LED component(s) should be updated necessarily include knowing or determining the particular LED component(s) to update. In some embodiments, the determination in step 606 may comprise simply identifying the LED component(s) corresponding to the detector component from which data had been received in step 602. In other embodiments, LED component(s) other than the LED component(s) corresponding to the detector component from which data had been received in step 602 may be identified for updating in step 608.

In step 610, an instruction for updating the LED component(s) identified in step 608 is transmitted to the LED component(s). In some embodiments, this instruction is transmitted directly to the LED component(s) while in other embodiments it is transmitted to a node controller, which then forwards the instruction to the LED component(s) (e.g., at an appropriate time, such as when the polling of RFID antennas near the LED component(s) is complete or not occurring).

It should be understood that although process 600 describes updating, or determining whether to update, at least one LED component of a table system based at least in part on data received from a detecting component of the table system, in other embodiments such a determination may be based on events or information other than data that is received from a detecting component of the table. For example, in one embodiment an "attract mode" lighting effect may be deemed appropriate whenever there is a period of time greater than a predetermined period of time (e.g., greater than five minutes) from a time at which a previous game or hand had been initiated at the table. In another example, an "currently unavailable" lighting effect may be deemed appropriate when the table system is engaged in a testing or reboot mode such that it cannot currently accept wagers. In yet another example, a program, dealer or other casino personnel may instruct the table system to go into a bonus mode lighting effect at one or more player positions or bet spots when a bonus prize is about to be awarded.

Rules of Interpretation & General Definitions

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, Local Area Network (LAN), Wide Area Network (WAN), or Ethernet (or IEEE 802.3), Token Ring, or via any appropriate communications means or combination of communications means. Exemplary protocols include but are not limited to: BLUETOOTH™, TDMA, CDMA, GSM, EDGE, GPRS, WCDMA, AMPS, D-AMPS, IEEE 802.11 (WI-FI), IEEE 802.3, SAP, SAS™ by IGT, SUPERSAS™, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cellular networks, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. An electronic table system operable to facilitate a card game, the electronic table system comprising:

a plurality of game areas, each of the game areas comprising a bet spot corresponding to (i) an RFID detecting component operable to detect data relating to a gaming element placed within the respective bet spot and (ii) at least one lighting component underneath a covering of the table surface within the bet spot;

a processor; and a memory storing a program for directing the processor, the processor being operable with the memory to:

receive first data from a first RFID detecting component, the first RFID detecting component from which the first data is received being associated with a first bet spot of a first game area of the plurality of game areas, the first bet spot also corresponding to a first lighting component that corresponds to the first RFID detecting component, wherein the first RFID detecting component is in communication with the processor and the first lighting component is in communication with a node controller;

retrieve information on a plurality of potential gaming events that can occur in association with card games playable at the electronic table system, each potential gaming event corresponding to a respective lighting effect;

determine that the first data corresponds to a first potential gaming event of the plurality of potential gaming events with respect to a current card game being played at the electronic table system, thereby determining a first lighting effect that corresponds to the first potential gaming event in accordance with the information;

identify one of the at least one lighting component to be updated with the first lighting effect corresponding to the first potential gaming event, thereby determining a target lighting component; and transmit an instruction to the target lighting component, instructing the target lighting component to implement the first lighting effect by:

determining at least one RFID antenna associated with the target lighting component, wherein the at least one RFID antenna can be the first RFID detecting component or another RFID detecting component;

confirming that the at least one RFID antenna associated with the target lighting component is not currently being polled; and transmitting the instruction to the target lighting component only after the confirming.

2. The electronic table system of claim 1, wherein the first lighting component and the target lighting component are located underneath a felt covering of a physical table comprising the electronic table system and the first lighting effect is visible to viewers of the physical table through the felt covering.

3. The electronic table system of claim 1, wherein the at least one potential gaming event comprises a first indication of a status of wagering for the current card game and wherein the first lighting effect outputs a second indication of the status of wagering to a viewer of the current card game.

4. The electronic table system of claim 3, wherein the status of wagering comprises the status of wagering at the first game area.

5. The electronic table system of claim 4, wherein the status of wagering comprises at least one of:

(i) a value of a wager at the first game area;

(ii) a relative magnitude of the wager at the first game area as compared to magnitudes of wagers at other game areas; and (iii) a special benefit associated with a physical game element placed on the first bet spot.

6. The electronic table system of claim 1, wherein the target lighting component comprises a second lighting component corresponding to a second bet spot of a second game area of the plurality of game areas.

7. The electronic table system of claim 1, wherein at least one of the first lighting component and the target lighting component comprises an LED component.

8. The electronic table system of claim 1, wherein the first RFID detecting component is disposed on a first circuit board and the first lighting component is disposed on a second circuit board that is distanced from the first circuit board.

9. The electronic table system of claim 1, wherein the processor being operable with the program to confirm that the at least one RFID antenna associated with the target lighting component is not currently being polled comprises the processor being operable with the program to access a schedule of RFID polling.

10. The electronic table system of claim 1, wherein the processor being operable with the program to confirm that the at least one RFID antenna associated with the target lighting component is not currently being polled comprises the processor being operable with the program to dynamically check a current status of RFID polling by the electronic table system.

11. The electronic table system of claim 10, wherein the processor being operable with the program to confirm that the at least one RFID antenna associated with the target lighting component is not currently being polled comprises the processor being operable with the program to:

determine that the at least one RFID antenna associated with the target lighting component is currently being polled; and queue the instruction for transmission at a time after it is confirmed that the at least one RFID antenna associated with the target lighting component is not currently being polled.

12. A computer readable medium storing instructions for directing a processor of an electronic table system operable to facilitate a card game to perform a method, the computer readable medium comprising a non-transitory computer-readable medium and the method comprising:

receive data from a first RFID detecting component, the first RFID detecting component from which the data is received being disposed to detect activity associated with a first bet spot of a first game area of a plurality of game areas of the electronic table system, the first bet spot also comprising a first lighting component that corresponds to the first RFID detecting component, wherein the first RFID detecting component is in communication with the processor and the first lighting component is in communication with a node controller;

retrieve information on a plurality of potential gaming events that can occur in association with card games playable at the electronic table system, each potential gaming event corresponding to a respective lighting effect;

determine that the data corresponds to a first potential gaming event of the plurality of potential gaming events with respect to a current card game being played at the electronic table system, thereby determining a first lighting effect that corresponds to the first potential gaming event in accordance with the information;

identify at least one lighting component to be updated with the first lighting effect corresponding to the first potential gaming event, thereby determining a target lighting component; and transmit an instruction to the target lighting component, instructing the target lighting component to implement the first lighting effect by:

determining at least one RFID antenna associated with the target lighting component, wherein the at least one RFID antenna can be the first RFID detecting component or another RFID detecting component;

confirming that the at least one RFID antenna associated with the target lighting component is not currently being polled; and transmitting the instruction to the target lighting component only after the confirming.

13. The computer readable medium of claim 12, wherein the first lighting component and the target lighting component are located underneath a felt covering of a physical table comprising the electronic table system and the first lighting effect is visible to viewers of the physical table through the felt covering.

14. The computer readable medium of claim 12, wherein the at least one potential gaming event comprises an indication of a status of wagering for the current card game and wherein the first lighting effect outputs an indication of the status of wagering to a viewer of the current card game.

15. The computer readable medium of claim 14, wherein the status of wagering comprises the status of wagering at the first game area.

16. The computer readable medium of claim 14, wherein the status of wagering comprises at least one of:

(i) a value of a wager at the first game area;

(ii) a relative magnitude of the wager at the first game area as compared to magnitudes of wagers at other game areas; and (iii) a special benefit associated with a physical game element placed on the first bet spot of the first game area.

17. The computer readable medium of claim 12, wherein confirming that the at least one RFID antenna associated with the target lighting component is not currently being polled comprises accessing a schedule of RFID polling.

18. The computer readable medium of claim 12, wherein confirming that the at least one RFID antenna associated with the target lighting component is not currently being polled comprises dynamically checking a current status of RFID polling by the electronic table system.

19. The computer readable medium of claim 18, wherein confirming that the at least one RFID antenna associated with the target lighting component is not currently being polled comprises:

determining that the at least one RFID antenna associated with the target lighting component is currently being polled; and queueing the instruction for transmission at a time after it is confirmed that the at least one RFID antenna associated with the target lighting component is not currently being polled.

* * * * *